US011099492B2

(12) United States Patent
Kusano et al.

(10) Patent No.: US 11,099,492 B2
(45) Date of Patent: Aug. 24, 2021

(54) ELECTROPHOTOGRAPHIC PHOTORECEPTOR, PROCESS CARTRIDGE, AND IMAGE FORMING APPARATUS

(71) Applicant: FUJIFILM Business Innovation Corp., Tokyo (JP)

(72) Inventors: Keisuke Kusano, Kanagawa (JP); Wataru Yamada, Kanagawa (JP); Masahiro Iwasaki, Kanagawa (JP); Ryosuke Fujii, Kanagawa (JP); Yuto Okazaki, Kanagawa (JP); Taisuke Fukui, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/744,210

(22) Filed: Jan. 16, 2020

(65) Prior Publication Data

US 2021/0088918 A1 Mar. 25, 2021

(30) Foreign Application Priority Data

Sep. 24, 2019 (JP) ..... JP2019-173034

(51) Int. Cl.

| | |
|---|---|
| ***G03G 5/05*** | (2006.01) |
| ***G03G 5/147*** | (2006.01) |
| ***G03G 15/00*** | (2006.01) |
| ***G03G 21/18*** | (2006.01) |

(52) U.S. Cl.

CPC ..... *G03G 5/0539* (2013.01); *G03G 5/14786* (2013.01); *G03G 5/14795* (2013.01); *G03G 15/75* (2013.01); *G03G 21/1803* (2013.01)

(58) Field of Classification Search

CPC ..... G03G 5/0539

See application file for complete search history.

(56) References Cited

U.S. PATENT DOCUMENTS

| | | | | |
|---|---|---|---|---|
| 4,792,507 | A * | 12/1988 | Yoshihara | G03G 5/14786 430/59.6 |
| 5,637,142 | A * | 6/1997 | Kubo | B29C 33/58 106/285 |
| 6,337,166 | B1 * | 1/2002 | Chambers | G03G 5/0539 430/132 |
| 6,833,403 | B1 * | 12/2004 | Bladel | C09D 127/18 524/458 |
| 2004/0115544 | A1 * | 6/2004 | Fu | G03G 5/0539 430/58.05 |
| 2013/0149540 | A1 * | 6/2013 | Sato | B05D 3/12 428/411.1 |
| 2016/0231657 | A1 * | 8/2016 | Miyamoto | G03G 5/0539 |

FOREIGN PATENT DOCUMENTS

| | | |
|---|---|---|
| JP | 2000019765 | 1/2000 |
| JP | 2005037836 | 2/2005 |
| JP | 2006184745 | 7/2006 |

* cited by examiner

*Primary Examiner* — Christopher D Rodee
(74) *Attorney, Agent, or Firm* — JCIPRNET

(57) ABSTRACT

An electrophotographic photoreceptor includes a conductive substrate and a photosensitive layer disposed on the conductive substrate. An outermost surface layer of the electrophotographic photoreceptor contains a fluorine-containing resin particle and a fluorine-based graft polymer having a fluorinated alkyl group. A ratio of an amount of a fluorine-based graft polymer separated from the fluorine-containing resin particle to a total amount of the fluorine-based graft polymer in the outermost surface layer is 15% or less.

14 Claims, 2 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2019-173034 filed Sep. 24, 2019.

BACKGROUND

(i) Technical Field

The present disclosure relates to an electrophotographic photoreceptor, a process cartridge, and an image forming apparatus.

(ii) Related Art

An apparatus that sequentially performs charging, formation of an electrostatic latent image, development, transfer, cleaning, etc. by using an electrophotographic photoreceptor (hereinafter may be referred to as a "photoreceptor") has been widely known as an electrophotographic image forming apparatus.

Examples of known electrophotographic photoreceptors include a function-separation-type photoreceptor in which a charge generation layer that generates charges and a charge transport layer that transports charges are formed on a conductive substrate such as an aluminum substrate, and a single-layer-type photoreceptor in which a single layer performs both the function of generating charges and the function of transporting charges.

For example, Japanese Unexamined Patent Application Publication No. 2000-019765 discloses an electrophotographic photoreceptor having a surface layer that contains fluorine-containing resin particles and a fluorine-containing comb-like graft polymer.

For example, Japanese Unexamined Patent Application Publication Nos. 2006-184745 and 2005-037836 disclose electrophotographic photoreceptors each having a surface layer that contains fluorine-based resin particles and a fluorine-based graft polymer.

SUMMARY

Hitherto, fluorine-containing resin particles have been blended in a surface layer of an electrophotographic photoreceptor in order to enhance the cleanability etc. In addition, a dispersant such as a fluorine-based graft polymer has been used to enhance the dispersibility of the fluorine-containing resin particles.

In producing a surface layer that contains fluorine-containing resin particles and a fluorine-based graft polymer, however, part of the fluorine-based graft polymer that does not adsorb on the fluorine-containing resin particles bleeds out on the outer surface side of the surface layer, which may result in degradation of charge retention characteristics of an electrophotographic photoreceptor.

Aspects of non-limiting embodiments of the present disclosure relate to an electrophotographic photoreceptor that has an outermost surface layer containing fluorine-containing resin particles and a fluorine-based graft polymer having a fluorinated alkyl group, and that has good charge retention characteristics compared to when a ratio of an amount of a fluorine-based graft polymer separated from the fluorine-containing resin particles to a total amount of the fluorine-based graft polymer in the outermost surface layer exceeds 15%.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an electrophotographic photoreceptor including a conductive substrate and a photosensitive layer disposed on the conductive substrate. An outermost surface layer of the electrophotographic photoreceptor contains a fluorine-containing resin particle and a fluorine-based graft polymer having a fluorinated alkyl group. A ratio of an amount of a fluorine-based graft polymer separated from the fluorine-containing resin particle to a total amount of the fluorine-based graft polymer in the outermost surface layer is 15% or less.

BRIEF DESCRIPTION OF THE DRAWINGS

Exemplary embodiments of the present disclosure will be described in detail based on the following figures, wherein.

DETAILED DESCRIPTION

Figure 1:
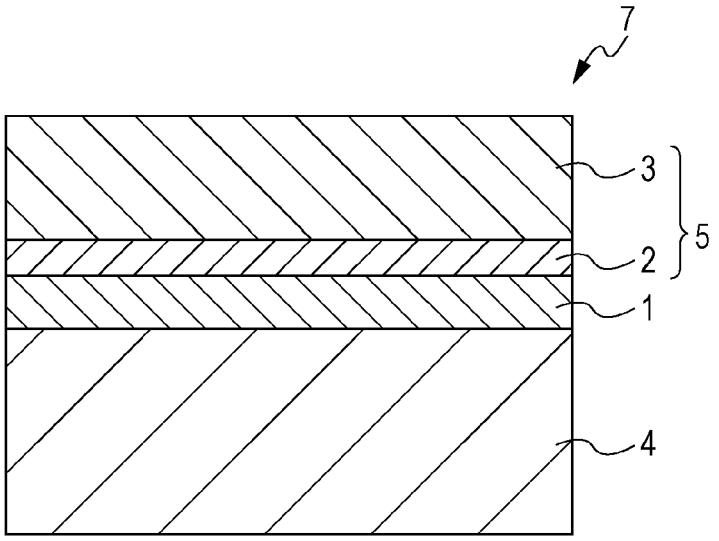
FIG. 1 is a schematic sectional view illustrating an example of a layer structure of an electrophotographic photoreceptor according to an exemplary embodiment.

Exemplary embodiments, which are examples of the present disclosure, will now be described in detail.

Electrophotographic Photoreceptor

An electrophotographic photoreceptor (hereinafter, also simply referred to as a "photoreceptor") according to the exemplary embodiment includes a conductive substrate and a photosensitive layer disposed on the conductive substrate, in which an outermost surface layer of the electrophotographic photoreceptor contains fluorine-containing resin particles and a fluorine-based graft polymer having a fluorinated alkyl group, and a ratio of an amount of a separated fluorine-based graft polymer to a total amount of the fluorine-based graft polymer in the outermost surface layer is 15% or less.

The photoreceptor according to the exemplary embodiment has good charge retention characteristics. The reason for this is presumably as follows.

As described above, in the case where an outermost surface layer of an electrophotographic photoreceptor contains fluorine-containing resin particles and a fluorine-based graft polymer, if the fluorine-based graft polymer that does not adsorb on the fluorine-containing resin particles but is separated from the fluorine-containing resin particles is present in a large amount, the fluorine-based graft polymer bleeds out on the outer surface side of the outermost surface layer, which may result in degradation of charge retention characteristics.

In view of this, the inventors of the present disclosure have found that the degradation of charge retention characteristics due to bleed-out of the fluorine-based graft polymer is suppressed when the amount of a separated fluorine-based graft polymer relative to the total amount of the fluorine-based graft polymer in the outermost surface layer is a particular value or less. This finding led to the completion of the present disclosure.

Presumably, the photoreceptor according to the exemplary embodiment has good charge retention characteristics because while the outermost surface layer contains fluorine-containing resin particles and a fluorine-based graft polymer, the amount of fluorine-based graft polymer in a state of being separated from the fluorine-containing resin particles is small in the outermost surface layer.

Furthermore, presumably, since the amount of fluorine-based graft polymer in a state of being separated from the fluorine-containing resin particles is small in the outermost surface layer, the surface texture of the outermost surface layer is stabilized, and the effect of improving cleanability achieved by the fluorine-containing resin particles is also effectively exhibited. As a result, it is considered that the photoreceptor according to the exemplary embodiment also has good cleanability.

Separation Ratio of Fluorine-Based Graft Polymer

In the photoreceptor according to the exemplary embodiment, a ratio of an amount of a fluorine-based graft polymer separated from the fluorine-containing resin particles to a total amount of the fluorine-based graft polymer in the outermost surface layer (hereinafter, also simply referred to as a "separation ratio") is 15% or less.

From the viewpoint of enhancing charge retention characteristics, the value of the separation ratio is preferably as small as possible. For example, the separation ratio is preferably 10% or less, more preferably 5% or less.

The lower limit of the separation ratio is, for example, 1%.

The separation ratio in the exemplary embodiment is determined by the following method.

First, 10 g of an outermost surface layer at an arbitrary position is removed from a photoreceptor by peeling and mixed with 30 g of a solvent (specifically, for example, tetrahydrofuran (THF)). The resulting liquid mixture is stirred for 180 minutes. After the completion of stirring, the liquid mixture is subjected to solid-liquid separation by centrifugal separation at 12,000 rpm for five minutes with a centrifugal separator (FB-4000, manufactured by KURABO INDUSTRIES LTD.).

Here, the fluorine-based graft polymer separated from the fluorine-containing resin particles dissolves in the solvent (THF) and, therefore, is present in the liquid after solid-liquid separation. That is, in the exemplary embodiment, the "fluorine-based graft polymer separated from fluorine-containing resin particles" refers to a fluorine-based graft polymer that is dissolved in the solvent (THF) by the mixing and stirring.

Subsequently, an amount (A) of the fluorine-based graft polymer which is present in the liquid after solid-liquid separation (i.e., which is dissolved in THF) is measured by the following method.

The liquid after solid-liquid separation (that is, the supernatant) is filtered through a filter having a pore diameter of 0.45 μm and then analyzed by gel permeation chromatography (GPC) under the following conditions. Apparatus: HLC-8120 manufactured by TOSOH CORPORATION Column: TSKgel SuperHM-H manufactured by TOSOH CORPORATION Column temperature: 40° C.

Eluent: THF

Next, a total amount of a fluorine-based graft polymer adsorbing on the fluorine-containing resin particles and a fluorine-based graft polymer separated from the fluorine-containing resin particles, the fluorine-based graft polymers being contained in the outermost surface layer, (that is, an amount of the whole fluorine-based graft polymer contained in the outermost surface layer) is measured by the following method.

First, 10 g of an outermost surface layer at an arbitrary position is removed from the photoreceptor by peeling. The outermost surface layer is mixed with 30 g of one solvent or a mixture of two or more solvents selected from aromatic hydrocarbons such as toluene and xylene, halogen solvents such as fluorocarbons, perfluorocarbons, hydrochlorofluorocarbons, methylene chloride, and chloroform, ester solvents such as ethyl acetate and butyl acetate, and ketone solvents such as acetone, methyl ethyl ketone, methyl isobutyl ketone, and cyclopentanone. The resulting liquid mixture is heated at 100° C. and stirred for 180 minutes. After the completion of stirring, the liquid mixture is subjected to solid-liquid separation by centrifugal separation at 12,000 rpm for five minutes with a centrifugal separator (FB-4000, manufactured by KURABO INDUSTRIES LTD.).

Through the above method, both the fluorine-based graft polymer adsorbing on the fluorine-containing resin particles and the fluorine-based graft polymer separated from the fluorine-containing resin particles dissolve in the solvent and are present in the liquid after solid-liquid separation.

Subsequently, an amount (B) of the fluorine-based graft polymer which is present in the liquid after solid-liquid separation (i.e., which is dissolved in the solvent) is measured by the following method.

The liquid after solid-liquid separation (that is, the supernatant) is filtered through a filter having a pore diameter of 0.45 μm and then analyzed by gel permeation chromatography (GPC) under the following conditions.

Apparatus: HLC-8120 manufactured by TOSOH CORPORATION

Column: TSKgel SuperHM-H manufactured by TOSOH CORPORATION

Column temperature: 40° C.

Eluent: THF

The separation ratio is determined by the following formula on the basis of the amount (A) of the fluorine-based graft polymer separated from the fluorine-containing resin particles and the total amount (B) of the fluorine-based graft polymer separated from the fluorine-containing resin particles and the fluorine-based graft polymer that has been adsorbed on the surfaces of the fluorine-containing resin particles, the amount (A) and the amount (B) being determined by the method described above.

Separation ratio (% by mass)=[amount (*A*) of fluorine-based graft polymer]/[amount (*B*) of fluorine-based graft polymer]×100

The separation ratio may be controlled by, for example, a method including using a fluorine-based graft polymer having good adsorptivity to fluorine-containing resin particles (in particular, property of maintaining adsorption) and a method for controlling the content of the fluorine-based graft polymer relative to the fluorine-containing resin particles.

Hereafter, a photoreceptor according to the exemplary embodiment will be described in detail.

Outermost Surface Layer

In the photoreceptor according to the exemplary embodiment, an outermost surface layer contains fluorine-containing resin particles and a fluorine-based graft polymer having a fluorinated alkyl group.

A charge transport layer, a protective layer, or a single-layer-type photosensitive layer corresponds to the outermost surface layer of the photoreceptor. The outermost surface layer contains components other than the fluorine-containing resin particles and the fluorine-based graft polymer depending on the type of the layer. The other components will be described together with the structures of layers of the photoreceptor.

Fluorine-Containing Resin Particles

Examples of the fluorine-containing resin particles include particles of a fluoroolefin homopolymer and particles of a copolymer of two or more monomers, the copolymer being a copolymer of one or two or more fluoroolefins and a fluorine-free monomer (that is, a monomer having no fluorine atom).

Examples of the fluoroolefin include perhaloolefins such as tetrafluoroethylene (also referred to as TFE), perfluorovinyl ether, hexafluoropropylene (also referred to as HFP), and chlorotrifluoroethylene (also referred to as CTFE) and non-perfluoroolefins such as vinylidene fluoride (also referred to as VdF), trifluoroethylene, and vinyl fluoride. Of these, for example, VdF, TFE, CTFE, and HFP are preferred.

On the other hand, examples of the fluorine-free monomer include hydrocarbon olefins such as ethylene, propylene, and butene; alkyl vinyl ethers such as cyclohexyl vinyl ether (also referred to as CHVE), ethyl vinyl ether (also referred to as EVE), butyl vinyl ether, and methyl vinyl ether; alkenyl vinyl ethers such as polyoxyethylene allyl ether (also referred to as POEAE) and ethyl allyl ether; organosilicon compounds having an active α,β-unsaturated group, such as vinyltrimethoxysilane (also referred to as VSi), vinyltriethoxysilane, and vinyltris(methoxyethoxy)silane; acrylic acid esters such as methyl acrylate and ethyl acrylate; methacrylic acid esters such as methyl methacrylate and ethyl methacrylate; and vinyl esters such as vinyl acetate, vinyl benzoate, and "VeoVa" (trade name, vinyl ester manufactured by Shell). Of these, alkyl vinyl ethers, vinyl esters, and organosilicon compounds having an active α,β-unsaturated group are preferred.

Of these, particles having a high fluorination rate are preferred as the fluorine-containing resin particles. Particles of polytetrafluoroethylene (also referred to as PTFE), tetrafluoroethylene-hexafluoropropylene copolymers (also referred to as FEP), tetrafluoroethylene-perfluoro(alkylvinyl ether) copolymers (also referred to as PFA), ethylene-tetrafluoroethylene copolymers (also referred to as ETFE), ethylene-chlorotrifluoroethylene copolymers (also referred to as ECTFE), and the like are more preferred, and particles of PTFE, FEP, and PFA are particularly preferred.

Examples of the fluorine-containing resin particles include particles obtained by being irradiated with radiation (hereinafter also referred to as "radiation irradiation-type fluorine-containing resin particles") and particles obtained by a polymerization method (hereinafter also referred to as "polymerization-type fluorine-containing resin particles").

The radiation irradiation-type fluorine-containing resin particles refer to fluorine-containing resin particles that are formed into particles along with radiation polymerization and fluorine-containing resin particles obtained by irradiating a fluorine-containing resin after polymerization with radiation to decompose the resin, thereby reducing the molecular weight and the size of the particles.

The radiation irradiation-type fluorine-containing resin particles are often produced as particles containing, as a by-product, a low-molecular compound having a carboxy group (for example, perfluorooctanoic acid) in the production process because a carboxylic acid is generated in a large amount by radiation irradiation in air.

On the other hand, the polymerization-type fluorine-containing resin particles refer to fluorine-containing resin particles that are formed into particles along with polymerization by, for example, a suspension polymerization method or an emulsion polymerization method and that are not irradiated with radiation.

An example of the method for producing fluorine-containing resin particles by suspension polymerization includes suspending additives such as a polymerization initiator and a catalyst in a dispersion medium together with a monomer for forming a fluorine-containing resin, and subsequently forming particles of a polymerized product while polymerizing the monomer.

An example of the method for producing fluorine-containing resin particles by emulsion polymerization includes emulsifying additives such as a polymerization initiator and a catalyst in a dispersion medium together with a monomer for forming a fluorine-containing resin by using a surfactant (that is, an emulsifier), and subsequently forming particles of a polymerized product while polymerizing the monomer.

The polymerization-type fluorine-containing resin particles are obtained by the polymerization method described above. Accordingly, unlike the radiation irradiation-type fluorine-containing resin particles, the polymerization-type fluorine-containing resin particles are unlikely to be produced as particles containing a low-molecular compound having a carboxy group.

The fluorine-containing resin particles contained in the outermost surface layer may be the radiation irradiation-type fluorine-containing resin particles or the polymerization-type fluorine-containing resin particles.

However, if the fluorine-containing resin particles are particles containing a low-molecular compound having a carboxy group, this low-molecular compound itself also bleeds out, which may cause degradation of charge retention characteristics.

Therefore, from the viewpoint of charge retention characteristics, the fluorine-containing resin particles contained in the outermost surface layer may be the polymerization-type fluorine-containing resin particles or the radiation irradiation-type fluorine-containing resin particles having a reduced content of a by-product.

A number-average particle size of primary particles of the fluorine-containing resin particles is not particularly limited but is preferably 0.05 μm or more and 1 μm or less, more preferably 0.1 μm or more and 0.5 μm or less.

The number-average particle size of the fluorine-containing resin particles is a value measured by the following method.

First, a specimen is prepared from an outermost surface layer containing fluorine-containing resin particles. The specimen prepared above is observed with a scanning electron microscope (SEM) at a magnification of, for example, 5,000 or more, and the maximum sizes of fluorine-containing resin particles in a primary particle state are measured. This measurement is performed for 50 particles. The average determined from the maximum sizes of the 50 fluorine-containing resin particles in the primary particle state is defined as the number-average particle size.

The SEM used here is JSM-6700F manufactured by JEOL Ltd., and a secondary electron image at an accelerating voltage of 5 kV is observed.

The content of the fluorine-containing resin particles is preferably 1% by mass or more and 30% by mass or less, more preferably 3% by mass or more and 20% by mass or less, still more preferably 5% by mass or more and 15% by mass or less relative to the total solid content of the outermost surface layer.

Fluorine-Based Graft Polymer

Next, a fluorine-based graft polymer will be described.

The fluorine-based graft polymer according to the exemplary embodiment is a fluorine-based graft polymer having a fluorinated alkyl group. The fluorine-based graft polymer functions as a fluorine-containing dispersant and contributes to dispersibility of the fluorine-containing resin particles.

The fluorine-based graft polymer is not particularly limited, preferably includes a structural unit A having a fluorinated alkyl group and a structural unit B having a graft chain, and particularly preferably includes a structural unit A having a fluorinated alkyl group having 2 to 8 carbon atoms and a structural unit B having a graft chain.

Herein, the "graft chain" means a branched polymer chain bound to a main chain (also referred to as a "trunk") and refers to a chain including a structural unit.

In particular, from the viewpoint of achieving the separation ratio described above, preferably, the fluorine-based graft polymer includes a structural unit A having a fluorinated alkyl group having 2 to 8 carbon atoms and a structural unit B having a graft chain, in which, in an infrared absorption spectrum, a ratio ($S_2/S_1$) of a peak area $S_2$ in a wavenumber range of from 1,020 $cm^{-1}$ to 1,308 $cm^{-1}$ to a peak area $S_1$ in a wavenumber range of from 1,673 $cm^{-1}$ to 1,779 $cm^{-1}$ is 2.7 or more and 4.8 or less (more preferably 2.9 or more and 3.9 or less).

The peak in the wavenumber range of from 1,020 $cm^{-1}$ to 1,308 $cm^{-1}$ corresponds to a peak due to a fluorine component of the fluorine-based graft polymer. Specifically, the peak area $S_2$ of this peak corresponds to the amount of fluorine component of the fluorine-based graft polymer. On the other hand, the peak in the wavenumber range of from 1,673 $cm^{-1}$ to 1,779 $cm^{-1}$ corresponds to a peak due to an ester moiety (that is, a moiety including >C═O) of the fluorine-based graft polymer. Specifically, the peak area $S_1$ of this peak corresponds to the amount of ester moiety of the fluorine-based graft polymer. Accordingly, the ratio ($S_2/S_1$) of the two peak areas corresponds to a ratio of the amount of fluorine component to the amount of ester moiety of the fluorine-based graft polymer.

The fluorine-based graft polymer having a peak area ratio ($S_2/S_1$) within the above range has high affinity to the fluorine-containing resin particles and easily achieves the separation ratio described above. Furthermore, since the fluorine-based graft polymer having a peak area ratio ($S_2/S_1$) within the above range has good affinity to the fluorine-containing resin particles, steric hindrance due to the fluorine-based graft polymer effectively exhibits, and dispersion stabilization of the fluorine-containing resin particles also enhances.

The infrared absorption spectrum of the fluorine-based graft polymer is measured by the following method.

First, a fluorine-based graft polymer to be measured is formed into a powder or a film to prepare a measurement sample for an attenuated total reflection method (ATR method). Next, for the measurement sample, measurement is performed with an infrared spectrophotometer (manufactured by JASCO CORPORATION: FT/IR-6100, equipped with an ATR unit and a ZnSe window) under the conditions of a number of scans of 64 times and a resolution of 4 $cm^{-1}$ in a wavenumber range of 650 $cm^{-1}$ or more and 4,000 $cm^{-1}$ or less, and an ATR correction is then performed. Thus, an infrared absorption spectrum is obtained.

A peak area in a wavenumber range of from 1,673 $cm^{-1}$ to 1,779 $cm^{-1}$ is determined as carbonyl groups in the fluorine-based graft polymer. Similarly, a peak area in a wavenumber range of from 1,020 $cm^{-1}$ to 1,308 $cm^{-1}$ is determined as the sum of C—F groups and C—O—C groups in the fluorine-based graft polymer.

Examples of the fluorine-based graft polymer preferably include polymers obtained by copolymerization of at least a monomer having a fluorinated alkyl group (preferably a fluorinated alkyl group having 2 to 8 carbon atoms) and a monomer that does not have a fluorinated alkyl group but has an ester group.

More specifically, examples of the fluorine-based graft polymer include random or block copolymers of a (meth) acrylate having a fluorinated alkyl group (preferably a fluorinated alkyl group having 2 to 8 carbon atoms) and a monomer that does not have a fluorinated alkyl group but has an ester group (>C═O). Herein, the "(meth)acrylate" refers to both an acrylate and a methacrylate.

Examples of the (meth)acrylate having a fluorinated alkyl group include 2,2,2-trifluoroethyl (meth)acrylate, 2,2,3,3,3-pentafluoropropyl (meth)acrylate, and perfluorohexylethyl (meth)acrylate.

Examples of the monomer that does not have a fluorinated alkyl group but has an ester group (>C═O) include publicly known macromonomers besides methoxypolyethylene glycol (meth)acrylate and phenoxypolyethylene glycol (meth) acrylate.

Examples of the publicly known macromonomers include MACROMONOMER AA-6 (polymethyl methacrylate whose terminal group is a methacryloyl group), AS-6 (polystyrene whose terminal group is a methacryloyl group), AN-6S (styrene-acrylonitrile copolymer whose terminal group is a methacryloyl group), and AB-6 (polybutyl acrylate whose terminal group is a methacryloyl group), all of which are manufactured by Toagosei Co., Ltd., PLACCEL FM5 (ε-caprolactone 5-mol equivalent adduct of 2-hydroxyethyl methacrylate) and FA10L (ε-caprolactone 10-mol equivalent adduct of 2-hydroxyethyl acrylate), both of which are manufactured by DAICEL CORPORATION, and polyester-based macromonomers described in Japanese Unexamined Patent Application Publication No. 2-272009.

In particular, the fluorine-based graft polymer may be a fluorinated alkyl group-containing polymer that includes a structural unit represented by general formula (FA) below and a structural unit represented by general formula (FB) below.

(FA)

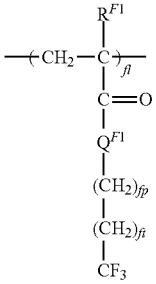

(FB)

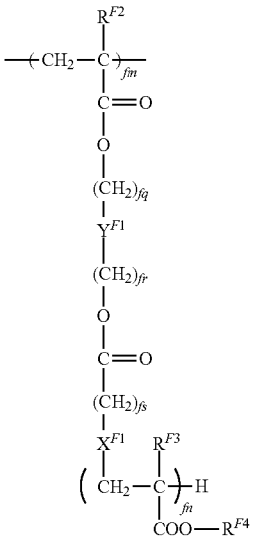

In general formulae (FA) and (FB), $R^{F2}$, $R^{F3}$, and $R^{F4}$ each independently represent a hydrogen atom or an alkyl group; $X^{F1}$ represents an alkylene chain, a halogen-substituted alkylene chain, —S—, —O—, —NH—, or a single bond; $Y^{F1}$ represents an alkylene chain, a halogen-substituted alkylene chain, —($C_{fx}H_{2fx-1}$(OH))—, or a single bond; $Q^{F1}$ represents —O— or —NH—; fl and fin each represent a content (% by mass) of the structural unit enclosed in parentheses relative to the total structural units of the fluorine-based graft polymer; fn is the number of structural units enclosed in parentheses and represents an integer of 1 or more; fp, fq, fr, and fs each independently represent an integer of 0 or 1 or more; ft represents an integer of 1 or more and 7 or less; and fx represents an integer of 1 or more.

In general formulae (FA) and (FB), the groups represented by $R^{F1}$, $R^{F2}$, $R^{F3}$, and $R^{F4}$ are each independently preferably, for example, a hydrogen atom, a methyl group, an ethyl group, or a propyl group, more preferably a hydrogen atom or a methyl group, still more preferably a methyl group.

In general formulae (FA) and (FB), the alkylene chains (unsubstituted alkylene chains and halogen-substituted alkylene chains) represented by $X^{F1}$ and $Y^{F1}$ are preferably linear or branched alkylene chains having 1 to 10 carbon atoms.

In —($C_{fx}H_{2fx-1}$(OH))— represented by $Y^{F1}$, fx preferably represents an integer of 1 or more and 10 or less.

Furthermore, fp, fq, fr, and fs preferably each independently represent an integer of 0 or 1 or more and 10 or less, and fn is preferably, for example, 1 or more and 60 or less.

In general formula (FA), ft is preferably an integer of 3 or more and 5 or less from the viewpoint of achieving the separation ratio described above.

When fl+fm is assumed to be 100 (% by mass), fl is preferably 30 (% by mass) or more and 45 (% by mass) or less, more preferably 35 (% by mass) or more and 45 (% by mass) or less.

The fluorine-based graft polymer is preferably a binary copolymer constituted by the structural unit A having a fluorinated alkyl group and the structural unit B having a graft chain. More specifically, the fluorine-based graft polymer is preferably a binary copolymer constituted by a structural unit represented by general formula (FA) and a structural unit represented by general formula (FB).

In the fluorinated alkyl group-containing polymer, when fl+fm is assumed to be 100 (% by mass), preferably, fl is 30 (% by mass) or more and 45 (% by mass) or less and fm is 55 (% by mass) or more and 70 (% by mass) or less, more preferably, fl is 35 (% by mass) or more and 45 (% by mass) or less and fm is 55 (% by mass) or more and 65 (% by mass) or less.

The fluorine-based graft polymer may further include a structural unit represented by general formula (FC) in addition to the structural unit represented by general formula (FA) and the structural unit represented by general formula (FB).

(FC)

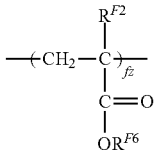

In general formula (FC), $R^{F5}$ and $R^{F6}$ each independently represent a hydrogen atom or an alkyl group, and fz represents an integer of 1 or more.

In general formula (FC), the groups represented by $R^{F5}$ and $R^{F6}$ are each independently preferably, for example, a hydrogen atom, a methyl group, an ethyl group, or a propyl group, more preferably a hydrogen atom or a methyl group, still more preferably a methyl group.

The content of the structural unit represented by general formula (FC) is preferably 8% by mass or less, more preferably 4% by mass or less relative to the total mass of the structural units represented by general formulae (FA) and (FB).

The lower limit of the content of the structural unit represented by general formula (FC) is, for example, 0% by mass.

The weight-average molecular weight Mw of the fluorine-based graft polymer is preferably 60,000 or more and 200,000 or less, more preferably 70,000 or more and 140,000 or less, more preferably 75,000 or more and 125,000 or less from the viewpoints of improving dispersibility of fluorine-containing resin particles and achieving the separation ratio.

The weight-average molecular weight Mw of the fluorine-based graft polymer is a value measured by gel permeation chromatography (GPC). The molecular weight measurement by GPC is conducted by, for example, using GPC•HLC-8120 manufactured by TOSOH CORPORATION as a measurement apparatus with TSKgel GMHHR-M+TSKgel GMHHR-M columns (7.8 mm I.D., 30 cm) manufactured by TOSOH CORPORATION and a tetrahydrofuran solvent. The molecular weight is calculated from the measurement results by using a molecular weight calibration curve prepared from monodisperse polystyrene standard samples.

The content of the fluorine-based graft polymer is, for example, preferably 1% by mass or more and 10% by mass or less, more preferably 1% by mass or more and 7% by mass or less relative to the fluorine-containing resin particles.

Fluorine-based graft polymers may be used alone or in combination of two or more thereof.

Perfluorooctanoic Acid

In the photoreceptor according to the exemplary embodiment, the outermost surface layer contains dispersant-carrying particles formed of the fluorine-containing resin particles having surfaces to which the fluorine-based graft polymer adheres.

The content of perfluorooctanoic acid (also referred to as PFOA) in the dispersant-carrying particles is preferably 0 ppb or more and 25 ppb or less relative to the total mass of the fluorine-containing resin particles.

That is, preferably, the dispersant-carrying particles contained in the outermost surface layer do not contain PFOA or have a reduced content of PFOA even if the dispersant-carrying particles contain PFOA.

In particular, in the cases of fluorine-containing resin particles such as polytetrafluoroethylene particles, modified polytetrafluoroethylene particles, and perfluoroalkyl ether/tetrafluoroethylene copolymer particles, PFOA may be used or generated as a by-product in the production process thereof, and thus the resulting fluorine-containing resin particles often contain PFOA.

Therefore, in order to reduce the PFOA content in the dispersant-carrying particles contained in the outermost surface layer, fluorine-containing resin particles having a reduced PFOA content may be used. That is, the PFOA content in the fluorine-containing resin particles is also preferably 0 ppb or more and 25 ppb or less relative to the total mass of the fluorine-containing resin particles.

An example of the method for reducing the amount of PFOA in fluorine-containing resin particles is a method that includes sufficiently washing fluorine-containing resin particles with, for example, pure water, alkaline water, an alcohol (such as methanol, ethanol, or isopropanol), a ketone (such as acetone, methyl ethyl ketone, or methyl isobutyl ketone), an ester (such as ethyl acetate), or another common organic solvent (such as toluene or tetrahydrofuran). Washing of the fluorine-containing resin particles may be conducted at room temperature. However, washing under heating enables the amount of PFOA in the fluorine-containing resin particles to be efficiently reduced.

The amount of PFOA in the dispersant-carrying particles is measured by the following method.

Pretreatment of Sample

When the amount of PFOA is measured from an outermost surface layer that contains dispersant-carrying particles, the outermost surface layer is immersed in a solvent (for example, tetrahydrofuran) to dissolve substances other than the dispersant-carrying particles and substances that are insoluble in the solvent (here, tetrahydrofuran), the resulting solution is then added to pure water dropwise, and the resulting precipitate is separated by filtration. The solution obtained at this time and containing PFOA is collected. The insoluble matter obtained by filtration is further dissolved in a solvent, the resulting solution is then added to pure water dropwise, and the resulting precipitate is separated by filtration. The solution obtained at this time and containing PFOA is collected. This operation of collecting the solution containing PFOA is repeated five times. The aqueous solution collected in all the operations is used as a pretreated aqueous solution.

When the amount of PFOA is measured from fluorine-containing resin particles themselves, the fluorine-containing resin particles are subjected to the same treatment as that in the case where PFOA is contained in an outermost surface layer to prepare a pretreated aqueous solution.

Measurement

A sample solution is prepared by using the pretreated aqueous solution obtained by the method described above. Adjustment and measurement of the sample solution are performed in accordance with the method described in "Analysis of Perfluorooctanesulfonic Acid (PFOS) and Perfluorooctanoic Acid (PFOA) in Environmental Water, Sediment, and Living Organisms, by Research Institute for Environmental Sciences and Public Health of Iwate Prefecture".

An electrophotographic photoreceptor according to the exemplary embodiment will now be described with reference to the drawings.

An electrophotographic photoreceptor 7 illustrated in FIG. 1 has a structure in which, for example, an undercoat layer 1, a charge generation layer 2, and a charge transport layer 3 are stacked on a conductive substrate 4 in this order. The charge generation layer 2 and the charge transport layer 3 constitute a photosensitive layer 5.

The electrophotographic photoreceptor 7 may have a layer structure that does not include the undercoat layer 1.

Alternatively, the electrophotographic photoreceptor 7 may be a photoreceptor including a single-layer-type photosensitive layer in which the functions of the charge generation layer 2 and the charge transport layer 3 are integrated. In the case of the photoreceptor including the single-layer-type photosensitive layer, the single-layer-type photosensitive layer may constitute the outermost surface layer.

Alternatively, the electrophotographic photoreceptor 7 may be a photoreceptor including a surface protection layer disposed on the charge transport layer 3 or the single-layer-type photosensitive layer. In the case of the photoreceptor including the surface protection layer, the surface protection layer constitutes the outermost surface layer.

The layers of the electrophotographic photoreceptor according to the exemplary embodiment will now be described in detail. In the description below, reference signs are omitted.

Conductive Substrate

Examples of the conductive substrate include metal plates, metal drums, and metal belts that contain a metal (such as aluminum, copper, zinc, chromium, nickel, molybdenum, vanadium, indium, gold, or platinum) or an alloy (such as stainless steel). Examples of the conductive substrate further include paper sheets, resin films, and belts coated, vapor-deposited, or laminated with a conductive compound (for example, a conductive polymer or indium oxide), a metal (for example, aluminum, palladium, or gold), or an alloy. Herein, "conductive" means that the volume resistivity is less than $10^{13}$ Ω·cm.

The surface of the conductive substrate may be roughened to have a center-line average roughness Ra of 0.04 μm or more and 0.5 μm or less in order to suppress interference fringes generated when the electrophotographic photoreceptor is used in a laser printer and is irradiated with a laser beam. When incoherent light is used as a light source, roughening of the surface for preventing interference fringes is not necessarily performed. However, roughening of the surface suppresses generation of defects due to irregularities on the surface of the conductive substrate and thus is suitable for further extending the lifetime.

Examples of the method for roughening the surface include wet honing with which an abrasive suspended in water is sprayed onto a conductive substrate, centerless grinding with which a conductive substrate is pressed against a rotating grinding stone to perform continuous grinding, and anodic oxidation treatment.

Another example of the method for roughening the surface is a method that includes, instead of roughening the surface of a conductive substrate, dispersing a conductive or semi-conductive powder in a resin, and forming a layer of the resulting resin on a surface of a conductive substrate to form a rough surface by the particles dispersed in the layer.

The surface roughening treatment by anodic oxidation includes anodizing a metal (for example, aluminum) conductive substrate serving as the anode in an electrolyte solution to thereby form an oxide film on the surface of the conductive substrate. Examples of the electrolyte solution include a sulfuric acid solution and an oxalic acid solution. However, a porous anodized film formed by anodic oxidation is chemically active in this state, is likely to be contaminated, and has resistivity that significantly varies depending on the environment. Therefore, the porous anodized film may be subjected to a pore-sealing treatment in which fine pores in the oxide film are sealed by volume expansion caused by hydration reaction in pressurized water vapor or boiling water (a metal salt such as a nickel salt may be added) so as to convert the oxide into a more stable hydrous oxide.

The thickness of the anodized film is preferably, for example, 0.3 μm or more and 15 μm or less. When the film thickness is within this range, a barrier property against injection tends to be exhibited, and a rise in the residual potential caused by repeated use tends to be suppressed.

The conductive substrate may be subjected to a treatment with an acidic treatment solution or a Boehmite treatment.

The treatment with an acidic treatment solution is conducted, for example, as follows. First, an acidic treatment solution containing phosphoric acid, chromic acid, and hydrofluoric acid is prepared. Regarding the blend ratio of phosphoric acid, chromic acid, and hydrofluoric acid in the acidic treatment solution, preferably, for example, phosphoric acid is in the range of from 10% by mass or more and 11% by mass or less, chromic acid is in the range of from 3% by mass or more and 5% by mass or less, hydrofluoric acid is in the range of from 0.5% by mass or more and 2% by mass or less, and the total concentration of these acids is preferably in the range of from 13.5% by mass or more and 18% by mass or less. The treatment temperature is preferably, for example, 42° C. or higher and 48° C. or lower. The resulting film preferably has a thickness of 0.3 μm or more and 15 μm or less.

The Boehmite treatment is conducted, for example, by immersing a conductive substrate in pure water at 90° C. or higher and 100° C. or lower for 5 to 60 minutes or by bringing a conductive substrate into contact with heated water vapor at 90° C. or higher and 120° C. or lower for 5 to 60 minutes. The resulting film preferably has a thickness of 0.1 μm or more and 5 μm or less. The resulting conductive substrate after the Boehmite treatment may be further anodized by using an electrolyte solution having a low film solubility, such as a solution of adipic acid, boric acid, a borate, a phosphate, a phthalate, a maleate, a benzoate, a tartrate, or a citrate.

Undercoat Layer

The undercoat layer is, for example, a layer that contains inorganic particles and a binder resin.

Examples of the inorganic particles include inorganic particles having a powder resistivity (volume resistivity) of $10^2$ Ω·cm or more and $10^{11}$ Ω·cm or less.

As the inorganic particles having the above resistivity, for example, metal oxide particles such as tin oxide particles, titanium oxide particles, zinc oxide particles, and zirconium oxide particles are preferred, and zinc oxide particles are particularly preferred.

The specific surface area of the inorganic particles as measured by the BET method may be, for example, 10 $m^2/g$ or more.

The volume-average particle size of the inorganic particles may be, for example, 50 nm or more and 2,000 nm or less (preferably 60 nm or more and 1,000 nm or less).

The content of the inorganic particles is, for example, preferably 10% by mass or more and 80% by mass or less, more preferably 40% by mass or more and 80% by mass or less relative to the binder resin.

The inorganic particles may be subjected to a surface treatment. The inorganic particles may be used as a mixture of two or more types of inorganic particles subjected to different surface treatments or a mixture of two or more types of inorganic particles having different particle sizes.

Examples of the surface treatment agent include silane coupling agents, titanate-based coupling agents, aluminum-based coupling agents, and surfactants. In particular, silane coupling agents are preferred, and amino-group-containing silane coupling agents are more preferred.

Examples of the amino-group-containing silane coupling agents include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Silane coupling agents may be used as a mixture of two or more thereof. For example, an amino-group-containing silane coupling agent and another silane coupling agent may be used in combination. Examples of the other silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxy silane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method with a surface treatment agent may be any publicly known method and, for example, may be a dry method or a wet method.

The treatment amount of the surface treatment agent is preferably, for example, 0.5% by mass or more and 10% by mass or less relative to the inorganic particles.

Here, the undercoat layer may contain an electron-accepting compound (acceptor compound) along with the inorganic particles from the viewpoint of enhancing long-term stability of electrical properties and carrier blocking properties.

Examples of the electron-accepting compound include electron-transporting substances such as quinone compounds, e.g., chloranil and bromanil; tetracyanoquinodimethane compounds; fluorenone compounds, e.g., 2,4,7-trinitrofluorenone and 2,4,5,7-tetranitro-9-fluorenone; oxadiazole compounds, e.g., 2-(4-biphenyl)-5-(4-tert-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds, e.g., 3,3',5,5'-tetra-tert-butyldiphenoquinone.

In particular, the electron-accepting compound is preferably a compound having an anthraquinone structure. Preferred examples of the compound having an anthraquinone structure include hydroxyanthraquinone compounds, aminoanthraquinone compounds, and aminohydroxyanthraquinone compounds. Specifically, for example, anthraquinone, alizarin, quinizarin, anthrarufin, and purpurin are preferred.

The electron-accepting compound may be contained in the undercoat layer in a state of being dispersed along with the inorganic particles or in a state of adhering to the surfaces of the inorganic particles.

Examples of the method for causing the electron-accepting compound to adhere to the surfaces of the inorganic particles include a dry method and a wet method.

An example of the dry method is a method with which, while inorganic particles are stirred with a mixer or the like that applies a large shear stress, an electron-accepting compound is added dropwise or sprayed along with dry air or nitrogen gas either directly or in the form of an organic solvent solution to cause the electron-accepting compound to adhere to the surfaces of the inorganic particles. The dropwise addition or spraying of the electron-accepting compound may be conducted at a temperature equal to or lower than the boiling point of the solvent. After the dropwise addition or spraying of the electron-accepting compound, baking may be further conducted at 100° C. or higher. The temperature and time for baking are not particularly limited as long as electrophotographic properties are obtained.

An example of the wet method is a method with which, while inorganic particles are dispersed in a solvent by stirring, by applying ultrasonic waves, or by using a sand mill, an attritor, a ball mill, or the like, an electron-accepting compound is added, and stirred or dispersed, and the solvent is then removed to cause the electron-accepting compound to adhere to the surfaces of the inorganic particles. Examples of the method for removing the solvent include filtration and distillation. After the removal of the solvent, baking may be further conducted at 100° C. or higher. The temperature and time for baking are not particularly limited as long as electrophotographic properties are obtained. In the wet method, water contained in the inorganic particles may be removed before the addition of the electron-accepting compound. Examples of the method for removing the water include a method for removing the water under stirring and heating in the solvent, and a method for removing the water by azeotropy with the solvent.

The adhesion of the electron-accepting compound may be conducted either before or after the inorganic particles are subjected to the surface treatment with the surface treatment agent. Alternatively, the adhesion of the electron-accepting compound and the surface treatment with the surface treatment agent may be conducted at the same time.

The content of the electron-accepting compound may be, for example, 0.01% by mass or more and 20% by mass or less and is preferably 0.01% by mass or more and 10% by mass or less relative to the inorganic particles.

Examples of the binder resin used in the undercoat layer include publicly known materials such as publicly known polymer compounds, e.g., acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organotitanium compounds; and silane coupling agents.

Examples of the binder resin used in the undercoat layer further include charge-transporting resins having charge-transporting groups, and conductive resins (such as polyaniline).

Of these, a resin that is insoluble in the coating solvent of the overlying layer is suitable as the binder resin used in the undercoat layer. Examples of the particularly suitable resin include thermosetting resins such as urea resins, phenolic resins, phenol-formaldehyde resins, melamine resins, urethane resins, unsaturated polyester resins, alkyd resins, and epoxy resins; and resins obtained by a reaction between a curing agent and at least one resin selected from the group consisting of polyamide resins, polyester resins, polyether resins, methacrylic resins, acrylic resins, polyvinyl alcohol resins, and polyvinyl acetal resins.

When two or more of these binder resins are used in combination, the mixing ratio is determined as necessary.

The undercoat layer may contain various additives to improve electrical properties, environmental stability, and image quality.

Examples of the additives include publicly known materials such as electron-transporting pigments formed of polycyclic condensed compounds, azo compounds, or the like, zirconium chelate compounds, titanium chelate compounds, aluminum chelate compounds, titanium alkoxide compounds, organotitanium compounds, and silane coupling agents. The silane coupling agents are used for the surface treatment of the inorganic particles as described above, but may be further added as an additive to the undercoat layer.

Examples of the silane coupling agents used as an additive include vinyltrimethoxysilane, 3-methacryloxypropyltris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butyrate, diethylacetoacetate aluminum diisopropylate, and aluminum tris(ethylacetoacetate).

These additives may be used alone or as a mixture or polycondensate of plural compounds.

The undercoat layer preferably has a Vickers hardness of 35 or more.

In order to suppress moire images, the surface roughness (ten-point average roughness) of the undercoat layer is preferably adjusted to be in the range of from 1/(4n) (where n represents the refractive index of the overlying layer) to ½ of the wavelength λ of the exposure laser used.

In order to adjust the surface roughness, resin particles and the like may be added to the undercoat layer. Examples of the resin particles include silicone resin particles and crosslinked polymethyl methacrylate resin particles. The surface of the undercoat layer may be polished to adjust the surface roughness. Examples of the polishing method include buff polishing, sand blasting, wet honing, and grinding.

The method for forming the undercoat layer is not particularly limited, and any known method is employed. For example, a coating film of a coating liquid for forming an undercoat layer, the coating liquid being prepared by adding the above components to a solvent, is formed, and the resulting coating film is dried and, if necessary, heated.

Examples of the solvent used for preparing the coating liquid for forming an undercoat layer include publicly known organic solvents such as alcohol solvents, aromatic hydrocarbon solvents, halogenated hydrocarbon solvents, ketone solvents, ketone alcohol solvents, ether solvents, and ester solvents.

Specific examples of the solvent include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method for dispersing inorganic particles in preparing the coating liquid for forming an undercoat layer include publicly known methods that use a roll mill, a ball mill, a vibrating ball mill, an attritor, a sand mill, a colloid mill, a paint shaker, or the like.

Examples of the method for applying the coating liquid for forming an undercoat layer to the conductive substrate include common methods such as a blade coating method, a wire bar coating method, a spray coating method, a dip coating method, a bead coating method, an air knife coating method, and a curtain coating method.

The thickness of the undercoat layer is, for example, preferably set within the range of 15 μm or more, more preferably 20 μm or more and 50 μm or less.

Intermediate Layer

An intermediate layer may be further disposed between the undercoat layer and the photosensitive layer, although not illustrated in the drawing.

The intermediate layer is, for example, a layer that contains a resin. Examples of the resin used in the intermediate layer include polymer compounds such as acetal resins (e.g., polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer that contains an organometallic compound. Examples of the organometallic compound used in the intermediate layer include organometallic compounds containing a metal atom such as zirconium, titanium, aluminum, manganese, or silicon.

These compounds used in the intermediate layer may be used alone or as a mixture or polycondensate of plural compounds.

In particular, the intermediate layer may be a layer that contains an organometallic compound containing zirconium atoms or silicon atoms.

The method for forming the intermediate layer is not particularly limited, and any known method is employed. For example, a coating film of a coating liquid for forming an intermediate layer, the coating liquid being prepared by adding the above components to a solvent, is formed, and the resulting coating film is dried and, if necessary, heated.

Examples of the application method for forming the intermediate layer include common methods such as a dip coating method, a lift coating method, a wire bar coating method, a spray coating method, a blade coating method, a knife coating method, and a curtain coating method.

The thickness of the intermediate layer is, for example, preferably set within the range of 0.1 μm or more and 3 μm or less. The intermediate layer may be used as the undercoat layer.

Charge Generation Layer

The charge generation layer is, for example, a layer that contains a charge-generating material and a binder resin. The charge generation layer may be a layer formed by vapor deposition of a charge-generating material. Such a layer formed by vapor deposition of a charge-generating material is suitable when an incoherent light source such as a light emitting diode (LED) or an organic electro-luminescence (EL) image array is used.

Examples of the charge-generating material include azo pigments such as bisazo and trisazo pigments, fused-ring aromatic pigments such as dibromoanthanthrone, perylene pigments, pyrrolopyrrole pigments, phthalocyanine pigments, zinc oxide, and trigonal selenium.

For laser exposure in the near-infrared region, of these, a metal phthalocyanine pigment or a metal-free phthalocyanine pigment is preferably used as the charge-generating material. Specifically, more preferred materials are, for example, hydroxygallium phthalocyanines disclosed in Japanese Unexamined Patent Application Publication Nos. 5-263007 and 5-279591; chlorogallium phthalocyanine disclosed in Japanese Unexamined Patent Application Publication No. 5-98181; dichlorotin phthalocyanines disclosed in Japanese Unexamined Patent Application Publication Nos. 5-140472 and 5-140473; and titanyl phthalocyanine disclosed in Japanese Unexamined Patent Application Publication No. 4-189873.

On the other hand, for laser exposure in the near-ultraviolet region, for example, a fused-ring aromatic pigment such as dibromoanthanthrone; a thioindigo pigment; a porphyrazine compound; zinc oxide; trigonal selenium; or any of the bisazo pigments disclosed in Japanese Unexamined Patent Application Publication Nos. 2004-78147 and 2005-181992 is preferably used as the charge-generating material.

When an incoherent light source, such as an LED or organic EL image array having an emission center wavelength in the range of 450 nm or more and 780 nm or less, is used, the charge-generating material described above may be used. However, from the viewpoint of the resolution, when the photosensitive layer is used in the form of a thin film having a thickness of 20 μm or less, the electric field strength in the photosensitive layer is increased, and a charge reduction due to charge injection from the substrate, that is, an image defect referred to as a "black spot" easily occurs. This becomes noticeable when a p-type semiconductor, which easily produces a dark current, such as trigonal selenium or a phthalocyanine pigment, is used as the charge-generating material.

In contrast, when an n-type semiconductor, such as a fused-ring aromatic pigment, a perylene pigment, or an azo pigment, is used as the charge-generating material, a dark current is unlikely to generate, and an image defect referred to as a black spot is suppressed even in the case of a thin film. Examples of n-type charge-generating materials include, but are not limited to, compounds (CG-1) to (CG-27) disclosed in paragraphs [0288] to [0291] of Japanese Unexamined Patent Application Publication No. 2012-155282.

Whether the n-type or not is determined on the basis of the polarity of a flowing photocurrent by a time-of-flight method that is commonly used. A material which allows electrons to flow more easily than holes as carriers is determined as the n-type.

The binder resin used in the charge generation layer is selected from a wide range of insulating resins. Alternatively, the binder resin may be selected from organic photoconductive polymers, such as poly-N-vinylcarbazole, polyvinyl anthracene, polyvinyl pyrene, and polysilane.

Examples of the binder resin include polyvinyl butyral resins, polyarylate resins (e.g., polycondensates of bisphenols and divalent aromatic carboxylic acids), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinylpyrrolidone resins. Herein, "insulating" means that the volume resistivity is $10^{13}$ Ω·cm or more.

These binder resins are used alone or as a mixture of two or more thereof.

The blend ratio of the charge-generating material to the binder resin is preferably in the range of from 10:1 to 1:10 in terms of mass ratio.

The charge generation layer may contain other known additives.

The method for forming the charge generation layer is not particularly limited, and any known method is employed. For example, a coating film of a coating liquid for forming a charge generation layer, the coating liquid being prepared by adding the above components to a solvent, is formed, and the resulting coating film is dried and, if necessary, heated. The charge generation layer may be formed by vapor deposition of a charge-generating material. The formation of the charge generation layer by vapor deposition is particularly suitable for the case where a fused-ring aromatic pigment or a perylene pigment is used as the charge-generating material.

Examples of the solvent used for preparing the coating liquid for forming a charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used alone or as a mixture of two or more thereof.

Examples of the method for dispersing particles (for example, the charge-generating material) in the coating liquid for forming a charge generation layer include methods using a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer. Examples of the high-pressure homogenizer include a collision-type homogenizer in which a dispersion is dispersed through liquid-liquid collision or liquid-wall collision in a high-pressure state, and a penetration-type homogenizer in which a dispersion is dispersed by causing the dispersion to penetrate through a fine flow path in a high-pressure state.

In the case of this dispersion, it is effective to adjust the average particle size of the charge-generating material in the coating liquid for forming a charge generation layer to 0.5 μm or less, preferably 0.3 μm or less, more preferably or 0.15 μm or less.

Examples of the method for applying the coating liquid for forming a charge generation layer to the undercoat layer (or the intermediate layer) include common methods such as a blade coating method, a wire bar coating method, a spray coating method, a dip coating method, a bead coating method, an air knife coating method, and a curtain coating method.

The thickness of the charge generation layer is, for example, preferably set within the range of 0.1 μm or more and 5.0 μm or less, more preferably 0.2 μm or more and 2.0 μm or less.

Charge Transport Layer

The charge transport layer is, for example, a layer that contains a charge-transporting material and a binder resin. The charge transport layer may be a layer that contains a polymer charge-transporting material.

Examples of the charge-transporting material include electron-transporting compounds such as quinone compounds, e.g., p-benzoquinone, chloranil, bromanil, and anthraquinone; tetracyanoquinodimethane compounds; fluorenone compounds, e.g., 2,4,7-trinitrofluorenone; xanthone compounds; benzophenone compounds; cyanovinyl compounds; and ethylene compounds. Other examples of the charge-transporting material include hole-transporting compounds such as triarylamine compounds, benzidine compounds, aryl alkane compounds, aryl-substituted ethylene compounds, stilbene compounds, anthracene compounds, and hydrazone compounds. These charge-transporting materials are used alone or in combination of two or more thereof. However, the charge-transporting material is not limited to these.

From the viewpoint of charge mobility, the charge-transporting material is preferably a triarylamine derivative represented by structural formula (a-1) below or a benzidine derivative represented by structural formula (a-2) below.

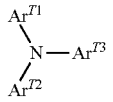

(a-1)

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$ where $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent for each of the groups described above include halogen atoms, alkyl groups having 1 to 5 carbon atoms, and alkoxy groups having 1 to 5 carbon atoms. Examples of the substituent for each of the groups described above further include substituted amino groups substituted with an alkyl group having 1 to 3 carbon atoms.

(a-2)

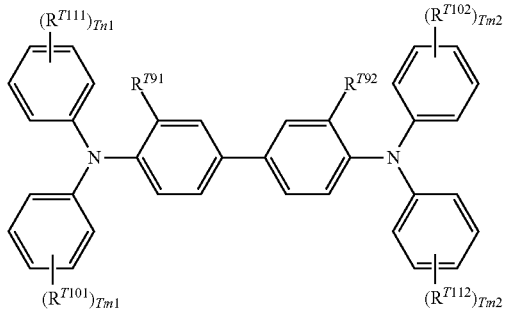

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms; $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$ where $R^{T12}$, $R^{T13}$, $R^{T14}$, $R^{T15}$ and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 or more and 2 or less.

Examples of the substituent for each of the groups described above include halogen atoms, alkyl groups having 1 to 5 carbon atoms, and alkoxy groups having 1 to 5 carbon atoms. Examples of the substituent for each of the groups described above further include substituted amino groups substituted with an alkyl group having 1 to 3 carbon atoms.

Here, among the triarylamine derivatives represented by structural formula (a-1) and the benzidine derivatives represented by structural formula (a-2), in particular, a triarylamine derivative having $—C_6H_4—CH=CH—CH=C(R^{T7})(R^{T8})$ and a benzidine derivative having $—CH=CH—CH=C(R^{T15})(R^{T16})$ are preferred from the viewpoint of charge mobility.

A publicly known polymer material having a charge-transporting property, such as poly-N-vinylcarbazole or polysilane is used as the polymer charge-transporting material. In particular, polyester polymer charge-transporting materials disclosed in Japanese Unexamined Patent Application Publication Nos. 8-176293 and 8-208820 are preferred. The polymer charge-transporting material may be used alone or in combination with a binder resin.

Examples of the binder resin used in the charge transport layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Of these, a polycarbonate resin or a polyarylate resin is suitable as the binder resin. These binder resins are used alone or in combination of two or more thereof.

The blend ratio of the charge-transporting material to the binder resin is preferably in the range of from 10:1 to 1:5 in terms of mass ratio.

The charge transport layer may further contain other known additives.

The method for forming the charge transport layer is not particularly limited, and any known method is employed. For example, a coating film of a coating liquid for forming a charge transport layer, the coating liquid being prepared by adding the above components to a solvent, is formed, and the resulting coating film is dried and, if necessary, heated.

Examples of the solvent used for preparing the coating liquid for forming a charge transport layer include common organic solvents such as aromatic hydrocarbons, e.g., benzene, toluene, xylene, and chlorobenzene; ketones, e.g., acetone and 2-butanone; halogenated aliphatic hydrocarbons, e.g., methylene chloride, chloroform, and ethylene chloride; and cyclic or linear ethers, e.g., tetrahydrofuran and ethyl ether. These solvents are used alone or as a mixture of two or more thereof.

Examples of the method for applying the coating liquid for forming a charge transport layer to the charge generation layer include common methods such as a blade coating method, a wire bar coating method, a spray coating method, a dip coating method, a bead coating method, an air knife coating method, and a curtain coating method.

The thickness of the charge transport layer is, for example, preferably set within the range of 5 μm or more and 50 μm or less, more preferably 10 μm or more and 30 μm or less.

Protective Layer

A protective layer is optionally disposed on a photosensitive layer. The protective layer is formed, for example, in order to prevent the photosensitive layer from being chemically changed during charging and to further improve the mechanical strength of the photosensitive layer.

Therefore, the protective layer may be a layer formed of a cured film (crosslinked film). Examples of such a layer include layers described in (1) and (2) below.

(1) A layer formed of a cured film of a composition that contains a reactive-group-containing charge-transporting material having a reactive group and a charge-transporting skeleton in the same molecule (that is, a layer that contains a polymer or crosslinked product of the reactive-group-containing charge-transporting material).

(2) A layer formed of a cured film of a composition that contains a non-reactive charge-transporting material, and a reactive-group-containing non-charge transporting material that does not have a charge-transporting skeleton but has a reactive group (that is, a layer that contains the non-reactive charge transporting material and a polymer or crosslinked product of the reactive-group-containing non-charge transporting material).

Examples of the reactive group contained in the reactive-group-containing charge-transporting material include known reactive groups such as chain-polymerizable groups, an epoxy group, —OH, —OR (where R represents an alkyl group), $—NH_2$, —SH, —COOH, and $—SiR^{Q1}{}_{3-Qn}(OR^{Q2})_{Qn}$ (where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3).

The chain-polymerizable group may be any radical-polymerizable functional group and is, for example, a functional group having a group that contains at least a carbon double bond. Specifically, an example thereof is a group that contains at least one selected from a vinyl group, a vinyl ether group, a vinyl thioether group, a styryl group (vinylphenyl group), an acryloyl group, a methacryloyl group, and derivatives thereof. Of these, the chain-polymerizable group is preferably a group that contains at least one selected from a vinyl group, a styryl group (vinylphenyl group), an acryloyl group, a methacryloyl group, and derivatives thereof in view of good reactivity.

The charge-transporting skeleton of the reactive-group-containing charge-transporting material may be any known structure used in an electrophotographic photoreceptor. Examples of the charge-transporting skeleton include skeletons that are derived from nitrogen-containing hole-transporting compounds, such as triarylamine compounds, benzidine compounds, and hydrazone compounds, and that have a structure conjugated with a nitrogen atom. Of these, a triarylamine skeleton is preferred.

The reactive-group-containing charge-transporting material that has a reactive group and a charge-transporting skeleton, the non-reactive charge-transporting material, and the reactive-group-containing non-charge transporting material may be selected from known materials.

The protective layer may further contain other known additives.

The method for forming the protective layer is not particularly limited, and any known method is employed. For example, a coating film of a coating liquid for forming a protective layer, the coating liquid being prepared by adding the above components to a solvent, is formed, and the resulting coating film is dried and, if necessary, subjected to a curing treatment such as heating.

Examples of the solvent used for preparing the coating liquid for forming a protective layer include aromatic solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvents such as isopropyl alcohol and butanol. These solvents are used alone or as a mixture of two or more thereof.

The coating liquid for forming a protective layer may be a solvent-free coating liquid.

Examples of the method for applying the coating liquid for forming a protective layer to the photosensitive layer (for example, the charge transport layer) include common methods such as a dip coating method, a lift coating method, a wire bar coating method, a spray coating method, a blade coating method, a knife coating method, and a curtain coating method.

The thickness of the protective layer is, for example, preferably set within the range of 1 μm or more and 20 μm or less, more preferably 2 μm or more and 10 μm or less.

Single-Layer-Type Photosensitive Layer

The single-layer-type photosensitive layer (charge generation/charge transport layer) is, for example, a layer that contains a charge-generating material, a charge-transporting material, and, optionally, a binder resin and other known additives. These materials are the same as those described in relation to the charge generation layer and the charge transport layer.

The content of the charge-generating material in the single-layer-type photosensitive layer may be 0.1% by mass or more and 10% by mass or less, and is preferably 0.8% by mass or more and 5% by mass or less relative to the total solid content. The content of the charge-transporting material in the single-layer-type photosensitive layer may be 5% by mass or more and 50% by mass or less relative to the total solid content.

The method for forming the single-layer-type photosensitive layer is the same as the method for forming the charge generation layer and the charge transport layer.

The thickness of the single-layer-type photosensitive layer may be, for example, 5 μm or more and 50 μm or less and is preferably 10 μm or more and 40 μm or less.

Image Forming Apparatus (and Process Cartridge)

An image forming apparatus according to an exemplary embodiment includes an electrophotographic photoreceptor, a charging unit that charges a surface of the electrophotographic photoreceptor, an electrostatic latent image forming unit that forms an electrostatic latent image on the charged surface of the electrophotographic photoreceptor, a developing unit that develops the electrostatic latent image formed on the surface of the electrophotographic photoreceptor by using a developer that contains a toner to form a toner image, and a transfer unit that transfers the toner image onto a surface of a recording medium. The electrophotographic photoreceptor according to the exemplary embodiment described above is used as the electrophotographic photoreceptor.

The image forming apparatus according to the exemplary embodiment is applied to a known image forming apparatus. Examples thereof include an apparatus including a fixing unit that fixes a toner image transferred onto the surface of a recording medium; a direct transfer-type apparatus in which a toner image formed on the surface of an electrophotographic photoreceptor is directly transferred onto a recording medium; an intermediate transfer-type apparatus in which a toner image formed on the surface of an electrophotographic photoreceptor is first transferred to a surface of an intermediate transfer body and the toner image transferred to the surface of the intermediate transfer body is then second transferred to a surface of a recording medium; an apparatus including a cleaning unit that cleans the surface of an electrophotographic photoreceptor after transfer of a toner image and before charging; an apparatus including a charge-erasing unit that erases charges on the surface of an electrophotographic photoreceptor by applying charge-erasing light after transfer of a toner image and before charging; and an apparatus including an electrophotographic photoreceptor heating member that increases the temperature of an electrophotographic photoreceptor to reduce the relative temperature.

In the intermediate transfer-type apparatus, the transfer unit includes, for example, an intermediate transfer body having a surface onto which a toner image is to be transferred, a first transfer unit that performs first transfer of the toner image formed on the surface of an electrophotographic photoreceptor onto the surface of the intermediate transfer body, and a second transfer unit that performs second transfer of the toner image transferred to the surface of the intermediate transfer body onto a surface of a recording medium.

The image forming apparatus according to the exemplary embodiment may be an image forming apparatus with a dry development system or an image forming apparatus with a wet development system (development system using a liquid developer).

In the image forming apparatus according to the exemplary embodiment, for example, a part that includes the electrophotographic photoreceptor may be configured as a cartridge structure (process cartridge) that is detachably attachable to the image forming apparatus. For example, a process cartridge including the electrophotographic photoreceptor according to the exemplary embodiment is suitably used as the process cartridge. The process cartridge may include, in addition to the electrophotographic photoreceptor, for example, at least one selected from the group consisting of a charging unit, an electrostatic latent image forming unit, a developing unit, and a transfer unit.

Examples of the image forming apparatus according to the exemplary embodiment will be described below but are not limited thereto. Only relevant parts illustrated in the drawings are described, and the description of other parts is omitted.

Figure 2:
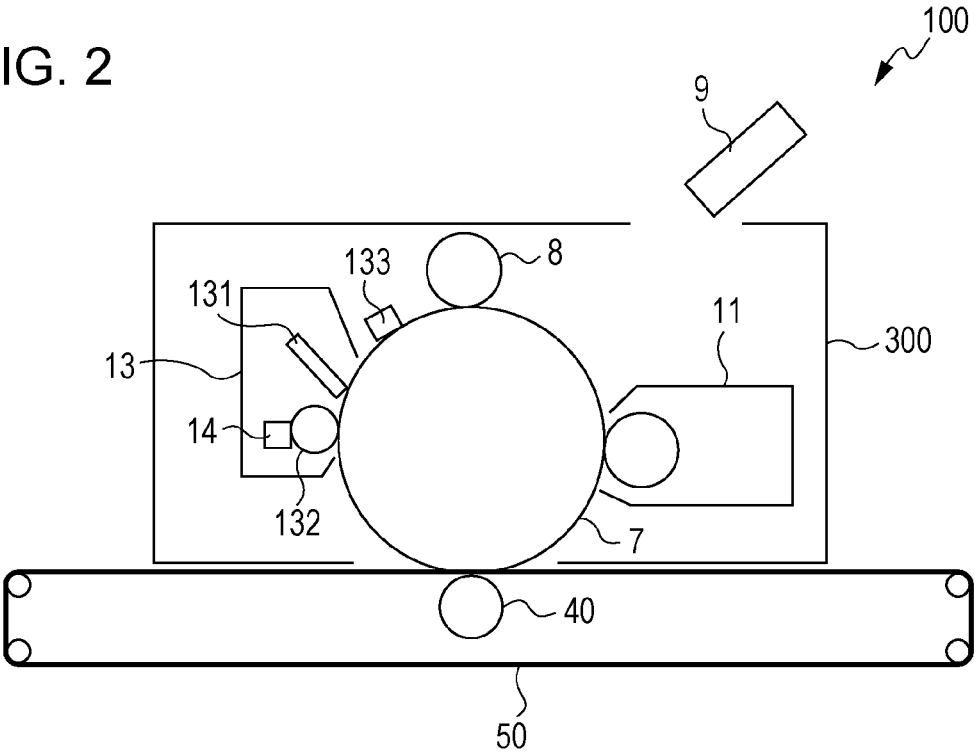
FIG. 2 is a schematic diagram illustrating an example of an image forming apparatus according to an exemplary embodiment.

FIG. 2 is a schematic diagram illustrating an example of an image forming apparatus according to the exemplary embodiment.

As illustrated in FIG. 2, an image forming apparatus 100 according to the exemplary embodiment includes a process cartridge 300 including an electrophotographic photoreceptor 7, an exposure device 9 (one example of an electrostatic latent image forming unit), a transfer device 40 (first transfer device), and an intermediate transfer body 50. In the image forming apparatus 100, the exposure device 9 is arranged at a position such that the exposure device 9 applies light to the electrophotographic photoreceptor 7 through an opening in the process cartridge 300. The transfer device 40 is arranged at a position facing the electrophotographic photoreceptor 7 with the intermediate transfer body 50 therebetween. The intermediate transfer body 50 is arranged such that a part of the intermediate transfer body 50 is in contact with the electrophotographic photoreceptor 7. The image forming apparatus 100 further includes a second transfer device (not illustrated) that transfers a toner image transferred to the intermediate transfer body 50 onto a recording medium (for example, a paper sheet). The intermediate transfer body 50, the transfer device 40 (first transfer device), and the second transfer device (not illustrated) correspond to examples of the transfer unit.

The process cartridge 300 in FIG. 2 includes a housing in which the electrophotographic photoreceptor 7, a charging device 8 (one example of a charging unit), a developing device 11 (one example of a developing unit), and a cleaning device 13 (one example of a cleaning unit) are integrally supported. The cleaning device 13 includes a cleaning blade 131 (one example of a cleaning member). The cleaning blade 131 is arranged to come in contact with a surface of the electrophotographic photoreceptor 7. The cleaning blade 131 may be used alone as the cleaning member. Alternatively, a conductive or insulating fibrous member and the cleaning blade 131 may be used in combination.

FIG. 2 illustrates an example of an image forming apparatus including a fibrous member 132 (roll-shaped) that supplies a lubricant 14 onto the surface of the electrophotographic photoreceptor 7, and a fibrous member 133 (flat brush-shaped) that assists cleaning. These members are arranged as required.

Structures of the components of the image forming apparatus according to the exemplary embodiment will now be described.

Charging Device

Examples of the charging device 8 include contact-type chargers that use, for example, conductive or semi-conductive charging rollers, charging brushes, charging films, charging rubber blades, or charging tubes. Non-contact-type roller chargers, and publicly known chargers such as scorotron chargers and corotron chargers that use corona discharge are also used.

Exposure Device

An example of the exposure device 9 is an optical device that exposes the surface of the electrophotographic photoreceptor 7 to light such as semiconductor laser light, LED light, liquid crystal shutter light, or the like so as to form a predetermined image pattern on the surface. The wavelength of the light source is within the spectral sensitivity range of the electrophotographic photoreceptor. Semiconductor lasers that are mainly used are near-infrared lasers having an oscillation wavelength of about 780 nm. However, the wavelength is not limited to this, and a laser having an oscillation wavelength on the order of 600 nm or a blue laser having an oscillation wavelength of 400 nm or more and 450 nm or less may also be used. In order to form color images, a surface-emitting laser light source capable of outputting a multibeam is also effective.

Developing Device

An example of the developing device 11 is a typical developing device that performs development by using a developer in a contact or non-contact manner. The developing device 11 is not limited as long as the device has the above function, and is selected in accordance with the purpose. An example thereof is a publicly known developing device having a function of causing a one-component developer or a two-component developer to adhere to the electrophotographic photoreceptor 7 with a brush, a roller, or the like. In particular, a developing device including a developing roller that carries the developer on the surface thereof may be used.

The developer used in the developing device 11 may be a one-component developer containing a toner alone or a two-component developer containing a toner and a carrier. The developer may be magnetic or nonmagnetic. Known developers may be used as these developers.

Cleaning Device

A cleaning blade-type device including the cleaning blade 131 is used as the cleaning device 13.

Instead of the cleaning blade-type device, a fur brush cleaning-type device or a simultaneous development cleaning-type device may be employed.

Transfer Device

Examples of the transfer device 40 include contact-type transfer chargers that use, for example, belts, rollers, films, or rubber blades, and publicly known transfer chargers such as scorotron transfer chargers and corotron transfer chargers that use corona discharge.

Intermediate Transfer Body

The intermediate transfer body 50 used is a belt-shaped member (intermediate transfer belt) containing a polyimide, polyamide-imide, polycarbonate, polyarylate, polyester, rubber, or the like that is imparted with semiconductivity. The form of the intermediate transfer body used may be a drum shape instead of the belt shape.

Figure 3:
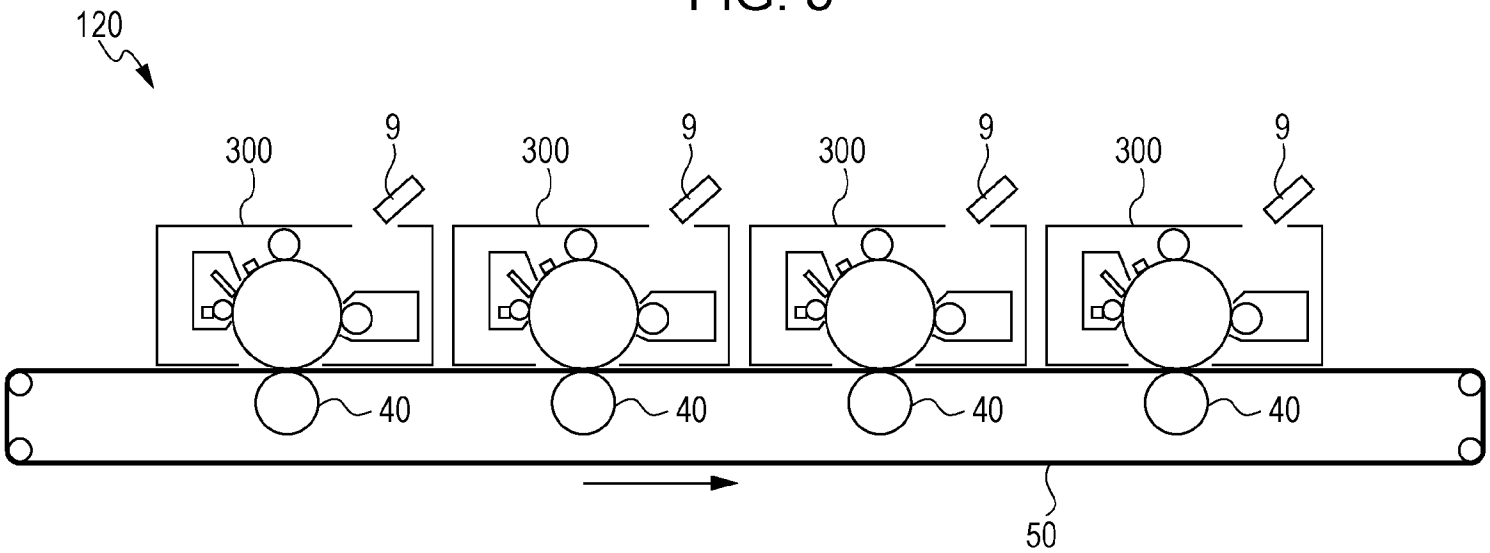
FIG. 3 is a schematic diagram illustrating another example of the image forming apparatus according to the exemplary embodiment.

FIG. 3 is a schematic diagram illustrating another example of the image forming apparatus according to the exemplary embodiment.

An image forming apparatus 120 illustrated in FIG. 3 is a tandem-system multicolor image forming apparatus including four process cartridges 300. In the image forming apparatus 120, the four process cartridges 300 are arranged in parallel on an intermediate transfer body 50, and one electrophotographic photoreceptor is used for one color. The image forming apparatus 120 has the same configuration as the image forming apparatus 100 except for the tandem system.

EXAMPLES

Examples of the present disclosure will now be described, but the present disclosure is not limited to the examples described below. In the description below, "part" and "%" are on a mass basis unless otherwise noted.

Production of Fluorine-Containing Resin Particles

Production of Fluorine-Containing Resin Particles (1)

Fluorine-containing resin particles (1) are produced as follows.

In a barrier nylon bag, 100 parts by mass of a commercially available homo-polytetrafluoroethylene fine powder (standard specific gravity measured in accordance with ASTM D 4895 (2004): 2.175) and 2.8 parts by mass of ethanol serving as an additive are placed. Subsequently, 160 kGy of cobalt-60 γ rays are applied at room temperature in air to obtain a low-molecular-weight polytetrafluoroethylene powder. The resulting powder is pulverized to obtain fluorine-containing resin particles (1).

Production of Fluorine-Containing Resin Particles (2)

In an autoclave equipped with a stirrer, 3.2 L of deionized water, 5.0 g of ammonium perfluorooctanoate, and 120 g of paraffin wax (manufactured by Nippon Oil Corporation) serving as an emulsion stabilizer are charged. The inside of the system is purged with nitrogen three times and with tetrafluoroethylene (TFE) twice to remove oxygen. Subsequently, the internal pressure is adjusted to 0.9 MPa with TFE, and the internal temperature is maintained at 80° C. while stirring at 250 rpm. Next, 20 mL of an aqueous solution prepared by dissolving 15 mg of ammonium persulfate in deionized water, and 20 mL of an aqueous solution prepared by dissolving 200 mg of succinic acid peroxide in deionized water are charged in the system to start a reaction. During the reaction, the temperature inside the system is maintained at 80° C., and TFE is continuously supplied so as to constantly maintain the internal pressure of the autoclave to 0.9 MPa. When the amount of TFE consumed by the reaction after the addition of the initiator reaches 1,100 g, the supply of TFE and stirring are stopped, and the pressure in the autoclave is released to the atmospheric pressure to terminate the reaction. The resulting emulsified liquid is allowed to stand and cooled, and the paraffin wax of the supernatant is then removed. Subsequently, the emulsified liquid is transferred to a stainless container equipped with a stirrer, 1.5 L of deionized water is added thereto, and the temperature of the resulting liquid is adjusted to 15° C. To the liquid, 100 g of an aqueous solution in which 20 g of ammonium carbonate and 2 g of triethylamine are dissolved is added, the liquid is stirred at 450 rpm to aggregate fluorine-containing resin particles. Subsequently, the particles are centrifugally separated. Next, the fluorine-containing resin particles are washed by adding 4 L of methanol, stirring the resulting mixture for 30 minutes, and then filtering the mixture. This washing operation is repeated four times, and the resulting fluorine-containing fine particles are dried in a fan dryer at 70° C. for 24 hours to produce fluorine-containing resin particles (2).

The number-average particle sizes of primary particles of the fluorine-containing resin particles (1) and (2) produced as described above are measured by the method described above.

Table 1 shows the results.

TABLE 1

| Fluorine-containing resin particle | | |
|---|---|---|
| No. | Production method | Number-average particle size [μm] |
| (1) | Radiation irradiation | 3.3 |
| (2) | Polymerization | 5.0 |

Production of Fluorine-Based Graft Polymer

Production of Fluorine-Based Graft Polymer (A)

A fluorine-based graft polymer (A) is synthesized as follows.

In a 500-mL reaction container equipped with a stirrer, a reflux condenser, a thermometer, and a nitrogen gas inlet, 5 parts by mass of methyl isobutyl ketone is placed and stirred, and a temperature of the solution in the reaction container is maintained at 80° C. in a nitrogen gas atmosphere. A mixed solution containing 9 parts by mass of perfluorohexylethyl acrylate, 21 parts by mass of MACROMONOMER AA-6 (manufactured by Toagosei Co., Ltd., LTD.), 0.3 parts by mass of PERHEXYL O (manufactured by NOF CORPORATION) serving as a polymerization initiator, and 45 parts by mass of methyl isobutyl ketone is added into the reaction container dropwise with a dropping syringe pump over a period of two hours. After completion of the dropwise addition, stirring is further continued for two hours, the temperature of the solution is then increased to 90° C., and stirring is further performed for two hours.

To the resulting methyl isobutyl ketone resin solution obtained after the reaction, 400 mL of methanol is added dropwise to precipitate a fluorine-based graft polymer. The precipitated solid is separated by filtration and then dried. Thus, a fluorine-based graft polymer (A) is obtained.

Production of Fluorine-Based Graft Polymer (B)

A fluorine-based graft polymer (B) is obtained as in the synthesis of the fluorine-based graft polymer (A) except that, in the synthesis of the fluorine-based graft polymer (A), the amount of PERHEXYL O is changed from 0.3 parts by mass to 0.2 parts by mass, and the amount of methyl isobutyl ketone is changed from 45 parts by mass to 40 parts by mass.

Production of Fluorine-Based Graft Polymer (C)

A fluorine-based graft polymer (C) is obtained as in the synthesis of the fluorine-based graft polymer (A) except that, in the synthesis of the fluorine-based graft polymer (A), the amount of methyl isobutyl ketone is changed from 45 parts by mass to 50 parts by mass.

Production of Fluorine-Based Graft Polymer (D)

A fluorine-based graft polymer (D) is obtained as in the synthesis of the fluorine-based graft polymer (A) except that, in the synthesis of the fluorine-based graft polymer (A), the amount of PERHEXYL O is changed from 0.3 parts by mass to 0.2 parts by mass, and the amount of methyl isobutyl ketone is changed from 45 parts by mass to 50 parts by mass.

Production of Fluorine-Based Graft Polymer (E)

A fluorine-based graft polymer (E) is obtained as in the synthesis of the fluorine-based graft polymer (A) except that, in the synthesis of the fluorine-based graft polymer (A), the amount of PERHEXYL O is changed from 0.3 parts by mass to 0.25 parts by mass.

Production of Fluorine-Based Graft Polymer (F)

A fluorine-based graft polymer (F) is obtained as in the synthesis of the fluorine-based graft polymer (A) except that, in the synthesis of the fluorine-based graft polymer (A), the amount of PERHEXYL O is changed from 0.3 parts by mass to 0.2 parts by mass.

Regarding each of the fluorine-based graft polymers (A) to (F), the weight-average molecular weight and the ratio (that is, $S_2/S_1$) of the peak area $S_2$ in the wavenumber range of from 1,020 $cm^{-1}$ to 1,308 $cm^{-1}$ to the peak area $S_1$ in the wavenumber range of from 1,673 $cm^{-1}$ to 1,779 $cm^{-1}$ in an infrared absorption spectrum are measured by the methods described above.

Table 2 shows the results.

TABLE 2

| Fluorine-based graft polymer | | |
|---|---|---|
| No. | Weight-average molecular weight | Peak area ratio $[S_2/S_1]$ |
| (A) | 99,000 | 2.53 |
| (B) | 116,000 | 3.74 |
| (C) | 20,300 | 2.70 |
| (D) | 26,500 | 3.94 |
| (E) | 95,000 | 2.93 |
| (F) | 80,300 | 3.82 |

Example 1

A photoreceptor is produced as follows.

Formation of Undercoat Layer

One hundred parts of zinc oxide (manufactured by TAYCA CORPORATION, average particle size: 70 nm, specific surface area: 15 $m^2/g$) is mixed with 500 parts of tetrahydrofuran under stirring, 1.3 parts of a silane coupling agent (KBM503, manufactured by Shin-Etsu Chemical Co., Ltd.) is added thereto, and the resulting mixture is stirred for two hours. Subsequently, tetrahydrofuran is distilled off by vacuum distillation, and baking is performed at 120° C. for three hours. Thus, zinc oxide having a surface treated with the silane coupling agent is obtained.

Next, 110 parts of the surface-treated zinc oxide is mixed with 500 parts of tetrahydrofuran under stirring, a solution prepared by dissolving 0.6 parts of alizarin in 50 parts of tetrahydrofuran is added to the resulting mixture, and the resulting mixture is stirred at 50° C. for five hours. Subsequently, the resulting alizarin-added zinc oxide is separated by vacuum filtration and further dried at 60° C. under reduced pressure. Thus, alizarin-added zinc oxide is obtained.

Sixty parts of the alizarin-added zinc oxide, 13.5 parts of a curing agent (blocked isocyanate, SUMIDUR 3175, manufactured by Sumika Bayer Urethane Co., Ltd.), 15 parts of a butyral resin (S-LEC BM-1, manufactured by Sekisui Chemical Co., Ltd.), and 85 parts of methyl ethyl ketone are mixed to obtain a mixed solution. Next, 38 parts of this mixed solution and 25 parts of methyl ethyl ketone are mixed, and the resulting mixture is dispersed for two hours in a sand mill by using glass beads having a diameter ϕ of 1 mm to obtain a dispersion liquid.

To the dispersion liquid, 0.005 parts of dioctyltin dilaurate serving as a catalyst and 45 parts of silicone resin particles (TOSPEARL 145, manufactured by MOMENTIVE PERFORMANCE MATERIALS JAPAN LLC) are added to prepare a coating liquid for forming an undercoat layer. The coating liquid is applied to an aluminum substrate having a diameter of 47 mm, a length of 357 mm, and a wall thickness of 1 mm by a dip coating method, and dried and cured at 170° C. for 30 minutes. Thus, an undercoat layer having a thickness of 25 μm is obtained.

Formation of Charge Generation Layer

A mixture containing 15 parts by mass of hydroxygallium phthalocyanine serving as a charge-generating material and having diffraction peaks at least at Bragg angles (2θ±0.2°) of 7.3°, 16.0°, 24.9° and 28.0° in an X-ray diffraction spectrum obtained by using CuKα characteristic X-rays, 10 parts by mass of a vinyl chloride-vinyl acetate copolymer (VMCH, manufactured by NUC CORPORATION) serving as a binder resin, and 200 parts by mass of n-butyl acetate is stirred and dispersed in a sand mill with glass beads having a diameter of 1 mm for four hours. To the resulting dispersion liquid, 175 parts by mass of n-butyl acetate and 180 parts by mass of methyl ethyl ketone are added, and the resulting mixture is stirred to prepare a coating liquid for forming a charge generation layer. The coating liquid for forming a charge generation layer is applied to the undercoat layer by dip coating and is then dried at 140° C. for 10 minutes. Thus, a charge generation layer having a thickness of 0.2 μm is formed.

Formation of Charge Transport Layer

To 800 parts by mass of tetrahydrofuran, 40 parts by mass of a charge-transporting material (HT-1) having the following structure, 8 parts by mass of a charge-transporting material (HT-2) having the following structure, and 52 parts by mass of a polycarbonate resin (A) having the following structure (viscosity-average molecular weight: 50,000) are added and dissolved. To the resulting solution, 8 parts by mass of the fluorine-containing resin particles (1) and 0.24 parts by mass (that is, the addition ratio relative to the fluorine-containing resin particles: 3.00% by mass) of the fluorine-based graft polymer (B) are added. The resulting solution is dispersed by using a homogenizer (ULTRA-TURRAX, manufactured by IKA) at 5,500 rpm for two hours to prepare a coating liquid for forming a charge transport layer. The coating liquid is applied to the charge generation layer and is then dried at 140° C. for 40 minutes. Thus, a charge transport layer having a thickness of 28 μm is formed. The resulting aluminum substrate is referred to as an electrophotographic photoreceptor 1.

(HT-1)

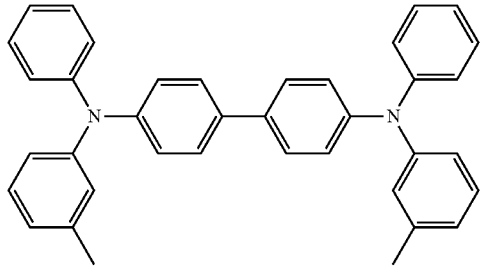

(HT-2)

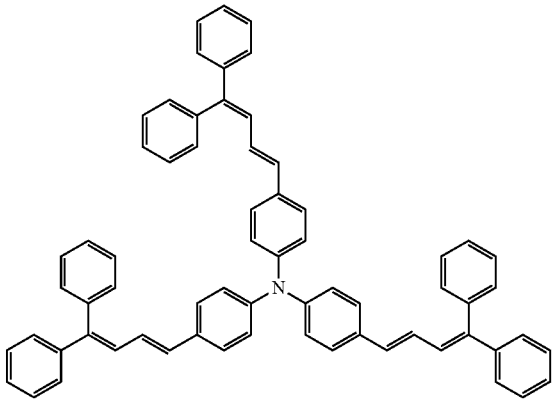

-continued

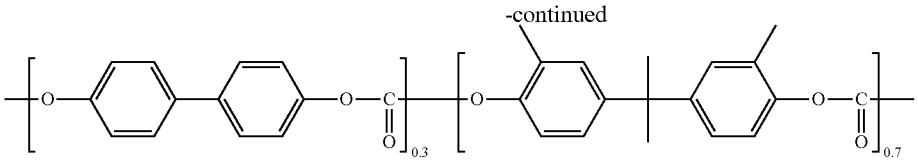

Polycarbonate resin (A)

Examples 2 to 16 and Comparative Examples 1 to 8

Photoreceptors are produced as in Example 1 except that the type and amount of fluorine-containing resin particles and the type and amount of fluorine-based graft polymer, the fluorine-containing resin particles and the fluorine-based graft polymer being blended in the charge transport layer, are suitably changed in accordance with Tables 3 and 4.

Measurement and Evaluation

Measurement of Separation Ratio

With regard to the photoreceptor produced in each of the examples, the separation ratio of the fluorine-based graft polymer in the outermost surface layer is measured by the method described above. Tables 3 and 4 show the results.

Measurement of Amount of PFOA

With regard to the photoreceptor produced in each of the examples, the amount of PFOA in the dispersant-carrying particles in the charge transport layer, which is the outermost surface layer, is measured by the method described above. Table 3 and 4 show the results.

Evaluation of Charge Retention Characteristics

The photoreceptor produced in each of the examples is installed in a photoreceptor electrical property evaluation device equipped with a charging device, an exposure device, and a charge-erasing device and manufactured by GENTEC Co., Ltd. A series of steps including charging, exposing, and charge-erasing is repeated for 100 cycles. Subsequently, the difference ΔVH in charge potential between the 1st cycle and the 100th cycle is measured in accordance with the conditions described below. Charge retention characteristics are evaluated on the basis of the ΔVH in accordance with the following evaluation criteria. Regarding the charge retention characteristics, grades G1 to G3 are acceptable levels. Tables 3 and 4 show the results.

Conditions

Measurement environment: 20° C./40%

Charge potential: +600 V

Intensity of exposure light: 10 (mJ/m$^2$)

Exposure wavelength: 780 (nm)

Charge-erasing light source: halogen lamp (manufactured by Hayashi-Repic Co., Ltd.)

Charge-erasing light wavelength: 600 nm or more and 800 nm or less

Intensity of charge-erasing light: 30 (mJ/m$^2$)

Speed of rotation: 66.7 (rpm)

Evaluation Criteria

G1: $0 \leq |\Delta VH| \leq 5$

G2: $5 < |\Delta VH| \leq 10$

G3: $10 < \Delta VH| \leq 25$

G4: $25 < |\Delta VH|$

Evaluation of Cleanability

The cleanability of the photoreceptor produced in each of the examples is evaluated as follows.

The photoreceptor produced in each of the examples is mounted on an image forming apparatus (trade name: ApeosPort-IV C3375 manufactured by Fuji Xerox Co., Ltd.). A halftone image with an image density of 5% is formed on A4 paper sheets (210×297 mm, P-paper, manufactured by Fuji Xerox Co., Ltd.) by using this apparatus in an initial state and in a high-temperature high-humidity environment (28° C., 85% RH) until the cumulative number of rotations of the photoreceptor reaches 100,000 cycles. Subsequently, a halftone image with an image density of 50% is successively output on 20 sheets. The image on the 20th sheet is visually observed to evaluate whether image defects such as streaks are generated or not. Regarding the cleanability, grades G1 to G3 are acceptable levels. Tables 3 and 4 show the results.

The evaluation is performed in accordance with the following evaluation criteria.

G1: No streak defects are observed, and there is no problem in terms of image quality.

G2: Although slight streak defects are observed, the defects are negligible in terms of image quality.

G3: Although streak defects are observed, the defects are negligible in terms of image quality.

G4: Streak defects are observed over the entire surface, and the defects cause a problem.

TABLE 3

| | Coating liquid for forming charge transport layer | | | | | Outermost surface layer | | Evaluation | |
|---|---|---|---|---|---|---|---|---|---|
| | Fluorine-containing resin particles | | Fluorine-based graft polymer | | Addition ratio | | | | |
| | Type | Amount [parts by mass] | Type | Amount [parts by mass] | relative to F particles [% by mass] | Separation ratio [%] | Amount of PFOA [ppb] | Charge retention characteristics | Cleanability |
| Example 1 | (1) | 8.0 | (B) | 0.24 | 3.00 | 4.5 | 500 | G2 | G2 |
| Example 2 | (1) | 8.0 | (E) | 0.24 | 3.00 | 11.8 | 500 | G3 | G3 |
| Example 3 | (1) | 8.0 | (F) | 0.24 | 3.00 | 3.5 | 500 | G2 | G2 |
| Example 4 | (2) | 8.0 | (B) | 0.24 | 3.00 | 3.9 | 0 | G1 | G1 |
| Example 5 | (2) | 8.0 | (B) | 0.32 | 4.00 | 5.2 | 0 | G1 | G1 |
| Example 6 | (2) | 8.0 | (B) | 0.40 | 5.00 | 6.5 | 0 | G1 | G1 |
| Example 7 | (2) | 16.0 | (B) | 0.48 | 3.00 | 7.8 | 0 | G1 | G1 |

TABLE 3-continued

| | Coating liquid for forming charge transport layer | | | | | | | | |
|---|---|---|---|---|---|---|---|---|---|
| | Fluorine-containing resin particles | | Fluorine-based graft polymer | | Addition ratio | Outermost surface layer | | Evaluation | |
| | Type | Amount [parts by mass] | Type | Amount [parts by mass] | relative to F particles [% by mass] | Separation ratio [%] | Amount of PFOA [ppb] | Charge retention characteristics | Cleanability |
| Example 8 | (2) | 16.0 | (B) | 0.64 | 4.00 | 10.4 | 0 | G2 | G2 |
| Example 9 | (2) | 16.0 | (B) | 0.80 | 5.00 | 13.0 | 0 | G2 | G2 |
| Comparative Example 1 | (2) | 8.0 | (A) | 0.24 | 3.00 | 15.4 | 0 | G4 | G4 |
| Comparative Example 2 | (2) | 8.0 | (C) | 0.24 | 3.00 | 60.3 | 0 | G4 | G4 |
| Comparative Example 3 | (2) | 8.0 | (D) | 0.24 | 3.00 | 23.0 | 0 | G4 | G4 |

TABLE 4

| | Coating liquid for forming charge transport layer | | | | | | | | |
|---|---|---|---|---|---|---|---|---|---|
| | Fluorine-containing resin particles | | Fluorine-based graft polymer | | Addition ratio | Outermost surface layer | | Evaluation | |
| | Type | Amount [parts by mass] | Type | Amount [parts by mass] | relative to F particles [% by mass] | Separation ratio [%} | Amount of PFOA [ppb] | Charge retention characteristics | Cleanability |
| Example 10 | (2) | 8.0 | (E) | 0.24 | 3.00 | 12.7 | 0 | G3 | G3 |
| Comparative Example 4 | (2) | 8.0 | (E) | 0.32 | 4.00 | 15.9 | 0 | G4 | G4 |
| Comparative Example 5 | (2) | 8.0 | (E) | 0.40 | 5.00 | 19.0 | 0 | G4 | G4 |
| Comparative Example 6 | (2) | 16.0 | (E) | 0.48 | 3.00 | 25.4 | 0 | G4 | G4 |
| Comparative Example 7 | (2) | 16.0 | (E) | 0.64 | 4.00 | 31.7 | 0 | G4 | G4 |
| Comparative Example 8 | (2) | 16.0 | (E) | 0.80 | 5.00 | 38.0 | 0 | G4 | G4 |
| Example 11 | (2) | 8.0 | (F) | 0.24 | 3.00 | 1.7 | 0 | G1 | G1 |
| Example 12 | (2) | 8.0 | (F) | 0.32 | 4.00 | 2.1 | 0 | G1 | G1 |
| Example 13 | (2) | 8.0 | (F) | 0.40 | 5.00 | 2.5 | 0 | G1 | G1 |
| Example 14 | (2) | 16.0 | (F) | 0.48 | 3.00 | 3.4 | 0 | G1 | G1 |
| Example 15 | (2) | 16.0 | (F) | 0.64 | 4.00 | 4.2 | 0 | G1 | G1 |
| Example 16 | (2) | 16.0 | (F) | 0.80 | 5.00 | 5.0 | 0 | G1 | G1 |

The above results show that, in the outermost surface layers of each of the photoreceptors of Examples, the ratio of the fluorine-based graft polymer separated from the fluorine-containing resin particles is lower than that in each of the photoreceptors of Comparative Examples, and thus the photoreceptors of Examples have good charge retention characteristics and good cleanability.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrophotographic photoreceptor comprising:

a conductive substrate; and a photosensitive layer disposed on the conductive substrate, wherein an outermost surface layer of the electrophotographic photoreceptor contains a fluorine-containing resin particle and a fluorine-based graft polymer having a fluorinated alkyl group, and a ratio of an amount of a fluorine-based graft polymer separated from the fluorine-containing resin particle to a total amount of the fluorine-based graft polymer in the outermost surface layer is 15% by mass or less, wherein the fluorine-based graft polymer has a weight-average molecular weight of 116,000 or more and 200,000 or less.

2. The electrophotographic photoreceptor according to claim 1, wherein the fluorine-based graft polymer includes a structural unit A having a fluorinated alkyl group having 2 to 8 carbon atoms and a structural unit B having a graft chain, and in an infrared absorption spectrum of the fluorine-based graft polymer, a ratio ($S_2/S_1$) of a peak area $S_2$ in a wavenumber range of from 1,020 $cm^{-1}$ to 1,308 $cm^{-1}$ to a peak area $S_1$ in a wavenumber range of from 1,673 $cm^{-1}$ to 1,779 $cm^{-1}$ is 2.7 or more and 4.8 or less.

3. The electrophotographic photoreceptor according to claim 2, wherein, in the infrared absorption spectrum of the fluorine-based graft polymer, the ratio ($S_2/S_1$) of the peak area $S_2$ in the wavenumber range of from 1,020 $cm^{-1}$ to 1,308 $cm^{-1}$ to the peak area $S_1$ in the wavenumber range of from 1,673 $cm^{-1}$ to 1,779 $cm^{-1}$ is 2.9 or more and 3.9 or less.

4. The electrophotographic photoreceptor according to claim 3, wherein the fluorine-based graft polymer is a binary copolymer constituted by a structural unit represented by general formula (FA) and a structural unit represented by general formula (FB), (FA)

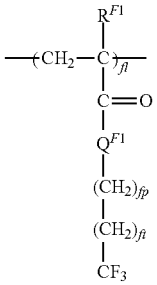

(FB)

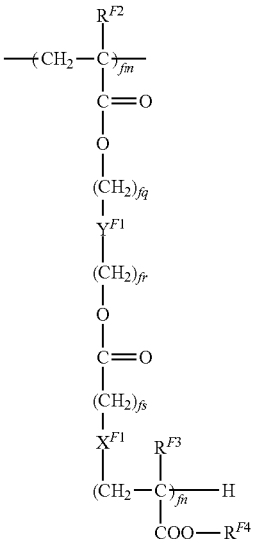

in the general formulae (FA) and (FB), $R^{F1}$, $R^{F2}$, $R^{F3}$, and $R^{F4}$ each independently represent a hydrogen atom or an alkyl group;

$X^{F1}$ represents an alkylene chain, a halogen-substituted alkylene chain, —S—, —O—, —NH—, or a single bond;

$Y^{F1}$ represents an alkylene chain, a halogen-substituted alkylene chain, —($C_{fx}H_{2fx-1}$(OH))—, or a single bond;

$Q^{F1}$ represents —O— or —NH—;

fl and fin each represent a content by mass of a structural unit enclosed in parentheses relative to the total structural units of the fluorine-based graft polymer;

fn is a number of structural units enclosed in parentheses and represents an integer of 1 or more;

fp, fq, fr, and fs each independently represent an integer of 0 or 1 or more;

ft represents an integer of 1 or more and 7 or less; and fx represents an integer of 1 or more.

5. The electrophotographic photoreceptor according to claim 3, wherein a content of the fluorine-based graft polymer is 1% by mass or more and 10% by mass or less relative to the fluorine-containing resin particle.

6. The electrophotographic photoreceptor according to claim 3, wherein the outermost surface layer contains a dispersant-carrying particle formed of the fluorine-containing resin particle having a surface to which the fluorine-based graft polymer adheres, and a content of perfluorooctanoic acid in the dispersant-carrying particle is 0 ppb or more and 25 ppb or less relative to a total mass of the fluorine-containing resin particle.

7. The electrophotographic photoreceptor according to claim 2, wherein the fluorine-based graft polymer is a binary copolymer constituted by a structural unit represented by general formula (FA) and a structural unit represented by general formula (FB), (FA)

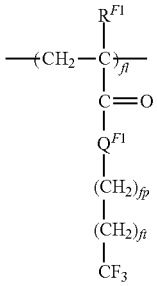

(FB)

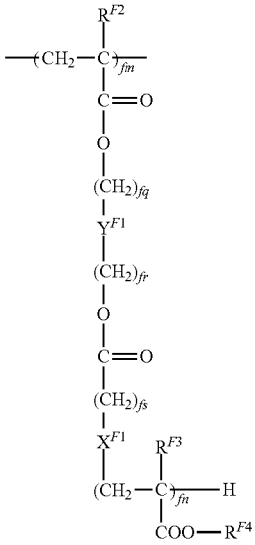

in the general formulae (FA) and (FB), $R^{F1}$, $R^{F2}$, $R^{F3}$, and $R^{F4}$ each independently represent a hydrogen atom or an alkyl group;

$X^{F1}$ represents an alkylene chain, a halogen-substituted alkylene chain, —S—, —O—, —NH—, or a single bond;

$Y^{F1}$ represents an alkylene chain, a halogen-substituted alkylene chain, —($C_{fx}H_{2fx-1}$(OH))—, or a single bond;

$Q^{F1}$ represents —O— or —NH—;

fl and fin each represent a content by mass of a structural unit enclosed in parentheses relative to the total structural units of the fluorine-based graft polymer;

fn is a number of structural units enclosed in parentheses and represents an integer of 1 or more;

fp, fq, fr, and fs each independently represent an integer of 0 or 1 or more;

ft represents an integer of 1 or more and 7 or less; and fx represents an integer of 1 or more.

8. The electrophotographic photoreceptor according to claim 2, wherein a content of the fluorine-based graft polymer is 1% by mass or more and 10% by mass or less relative to the fluorine-containing resin particle.

9. The electrophotographic photoreceptor according to claim 2, wherein the outermost surface layer contains a dispersant-carrying particle formed of the fluorine-containing resin particle having a surface to which the fluorine-based graft polymer adheres, and a content of perfluorooctanoic acid in the dispersant-carrying particle is 0 ppb or more and 25 ppb or less relative to a total mass of the fluorine-containing resin particle.

10. The electrophotographic photoreceptor according to claim 1, wherein the fluorine-based graft polymer is a binary copolymer constituted by a structural unit represented by general formula (FA) and a structural unit represented by general formula (FB), (FA)

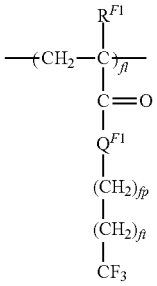

(FB)

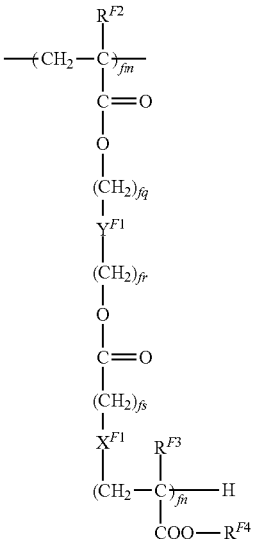

in the general formulae (FA) and (FB), $R^{F1}$, $R^{F2}$, $R^{F3}$, and $R^{F4}$ each independently represent a hydrogen atom or an alkyl group;

$X^{F1}$ represents an alkylene chain, a halogen-substituted alkylene chain, —S—, —O—, —NH—, or a single bond;

$Y^{F1}$ represents an alkylene chain, a halogen-substituted alkylene chain, —($C_{fx}H_{2fx-1}$(OH))—, or a single bond;

$Q^{F1}$ represents —O— or —NH—;

fl and fin each represent a content by mass of a structural unit enclosed in parentheses relative to the total structural units of the fluorine-based graft polymer;

fn is a number of structural units enclosed in parentheses and represents an integer of 1 or more;

fp, fq, fr, and fs each independently represent an integer of 0 or 1 or more;

ft represents an integer of 1 or more and 7 or less; and fx represents an integer of 1 or more.

11. The electrophotographic photoreceptor according to claim 1, wherein a content of the fluorine-based graft polymer is 1% by mass or more and 10% by mass or less relative to the fluorine-containing resin particle.

12. The electrophotographic photoreceptor according to claim 1, wherein the outermost surface layer contains a dispersant-carrying particle formed of the fluorine-containing resin particle having a surface to which the fluorine-based graft polymer adheres, and a content of perfluorooctanoic acid in the dispersant-carrying particle is 0 ppb or more and 25 ppb or less relative to a total mass of the fluorine-containing resin particle.

13. A process cartridge detachably attachable to an image forming apparatus, the process cartridge comprising:

the electrophotographic photoreceptor according to claim 1.

14. An image forming apparatus comprising:

the electrophotographic photoreceptor according to claim 1;

a charging unit that charges a surface of the electrophotographic photoreceptor;

an electrostatic latent image forming unit that forms an electrostatic latent image on the charged surface of the electrophotographic photoreceptor;

a developing unit that develops the electrostatic latent image formed on the surface of the electrophotographic photoreceptor by using a developer that contains a toner to form a toner image; and a transfer unit that transfers the toner image onto a surface of a recording medium.

* * * * *